US012053083B2

(12) United States Patent
Liu et al.

(10) Patent No.: US 12,053,083 B2
(45) Date of Patent: Aug. 6, 2024

(54) ORAL CARE IMPLEMENT

(71) Applicant: Colgate-Palmolive Company, New York, NY (US)

(72) Inventors: Chang L. Liu, Yangzhou (CN); Jiang Zhou, Yangzhou (CN); Yanmei Ji, Jiangsu (CN); Fan Gang Xie, Shanghai (CN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 18/182,898

(22) Filed: Mar. 13, 2023

(65) Prior Publication Data

US 2023/0225493 A1 Jul. 20, 2023

Related U.S. Application Data

(63) Continuation of application No. 16/619,122, filed as application No. PCT/CN2018/120836 on Dec. 13, 2018, now Pat. No. 11,622,618.

(51) Int. Cl.
*A46B 9/04* (2006.01)
*A46B 9/02* (2006.01)
(Continued)

(52) U.S. Cl.
CPC ..... *A46B 9/04* (2013.01); *A46B 9/028* (2013.01); *A46B 9/06* (2013.01); *A46D 1/0276* (2013.01);
(Continued)

(58) Field of Classification Search
CPC .. A46B 9/028; A46B 9/04; A46B 9/06; A46B 9/026; A46B 9/025; A46B 9/02; A46B 2200/1066
See application file for complete search history.

(56) References Cited

U.S. PATENT DOCUMENTS 1,364,971 A 1/1921 Alexander
1,559,114 A 10/1925 Maranville
(Continued)

FOREIGN PATENT DOCUMENTS

AU 2012203910 7/2012
BR 6805219-7 3/2009
(Continued)

OTHER PUBLICATIONS

Colgate, Colgate Cushion Clean Super Dense Fluffy Thin Toothbrush Valuepack (Soft), 2ct, retrieved Jun. 15, 2022 from Amazon website, https://www.amazon.sg/Colgate-Cushion-Fluffy-Toothbrush-Valuepack/dp/B07VM7RS5S, pp. 1-4.
(Continued)

*Primary Examiner* — Laura C Guidotti

(57) ABSTRACT

An oral care implement having a head with a plurality of cleaning elements coupled thereto and extending therefrom. In the exemplified embodiment, the cleaning elements have a plurality of bristle tufts each including a plurality of bristle filaments. In one aspect, the oral care implement may include a first bristle tuft having inner and outer filaments with the outer filaments being taller than the inner filaments and a second bristle tuft having inner and outer filaments with the outer filaments being shorter than the inner filaments. The first bristle tufts may be arranged on the head in a position so as to surround the second bristle tufts, or the second bristle tufts may be arranged on the head in a position so as to surround the first bristle tufts. Distal ends of the first and second bristle tufts may be angled.

20 Claims, 13 Drawing Sheets

(51) Int. Cl.
*A46B 9/06* (2006.01)
*A46D 1/00* (2006.01)

(52) U.S. Cl.
CPC ..... *A46B 9/065* (2013.01); *A46B 2200/1066* (2013.01)

(56) References Cited

U.S. PATENT DOCUMENTS 2,040,245 A 5/1936 Crawford
2,043,898 A * 6/1936 Malcolm ..... A46B 9/04 15/167.1
D144,163 S 3/1946 Dolnick
2,797,424 A 7/1957 Olson
3,295,156 A 1/1967 Brant
3,934,298 A 1/1976 Kim
D278,661 S 5/1985 Gelsen
4,979,782 A 12/1990 Weihrauch
5,380,202 A 1/1995 Brahler
5,392,483 A * 2/1995 Heinzelman ..... A46B 9/04 15/167.1
D357,121 S 4/1995 Fuentes et al.
5,533,227 A 7/1996 Ito et al.
5,535,474 A 7/1996 Salazar
5,655,249 A 8/1997 Li
D387,205 S 12/1997 Moskovich
D397,872 S 9/1998 Moskovich et al.
D404,205 S 1/1999 Hohlbein
D427,437 S 7/2000 Vonarburg
D441,958 S 5/2001 Rueb
6,260,227 B1 7/2001 Fulop et al.
D446,393 S 8/2001 Manfredi et al.
D456,136 S 4/2002 Roehrig
6,421,867 B1 7/2002 Weihrauch
6,438,786 B2 8/2002 Harada
D462,527 S 9/2002 Ping
D471,363 S 3/2003 Grau et al.
6,546,586 B2 4/2003 Cho
D475,529 S 6/2003 Wright et al.
D475,531 S 6/2003 Klimeck et al.
D476,156 S 6/2003 Ferber et al.
D476,487 S 7/2003 Saindon et al.
D479,914 S 9/2003 Choong
D480,213 S 10/2003 Ping
D480,214 S 10/2003 Kling et al.
D490,613 S 6/2004 Wong
D494,370 S 8/2004 Wong
D510,807 S 10/2005 Jimenez
D513,126 S 12/2005 Jimenez et al.
D513,882 S 1/2006 Hohlbein et al.
D517,812 S 3/2006 Hohlbein et al.
7,047,591 B2 5/2006 Hohlbein
D527,907 S 9/2006 Kling et al.
7,213,288 B2 5/2007 Hohlbein
D558,980 S 1/2008 Jimenez et al.
D577,493 S 9/2008 Wong
7,458,125 B2 12/2008 Hohlbein et al.
D590,597 S 4/2009 Geiberger
D599,555 S 9/2009 Oliphant
D615,761 S 5/2010 Wong
D619,717 S 7/2010 Toshima
7,788,756 B2 9/2010 Kraemer
7,814,603 B2 10/2010 Gavney, Jr.
7,841,041 B2 11/2010 Moskovich et al.
D630,020 S 1/2011 Wong
D634,934 S 3/2011 Kalbfeld et al.
7,899,905 B2 3/2011 Rahman et al.
D635,775 S 4/2011 Kalbfeld et al.
8,006,342 B2 8/2011 Nanda
D645,254 S 9/2011 Xi et al.
D654,270 S 2/2012 Jimenez et al.
D654,695 S 2/2012 Jimenez et al.
D654,696 S 2/2012 Jimenez et al.
8,108,962 B2 2/2012 Davidson et al.
8,151,397 B2 4/2012 Moskovich et al.
D661,100 S 6/2012 Nanda
D661,490 S 6/2012 Jin et al.
D664,359 S 7/2012 Xi et al.
D666,005 S 8/2012 Winkler
D671,326 S 11/2012 Jimenez et al.
D672,561 S 12/2012 Jin et al.
D674,609 S 1/2013 Li
D675,830 S 2/2013 Jimenez et al.
8,387,196 B2 3/2013 Jimenez et al.
8,464,388 B2 6/2013 Chen
D686,825 S 7/2013 Xi et al.
8,499,401 B2 8/2013 Davidson et al.
8,511,323 B2 8/2013 Jimenez et al.
D692,242 S 10/2013 Jimenez et al.
8,549,691 B2 10/2013 Moskovich et al.
D698,554 S 2/2014 Xi et al.
D704,447 S 5/2014 Xi et al.
D706,036 S 6/2014 Xi et al.
8,777,615 B2 7/2014 Hayman et al.
8,784,102 B1 7/2014 Kumar
D710,111 S 8/2014 Ding et al.
8,800,093 B2 8/2014 Moskovich et al.
8,813,292 B2 8/2014 Driesen et al.
8,813,296 B2 8/2014 Moskovich et al.
8,839,481 B2 9/2014 Moskovich et al.
9,033,899 B2 5/2015 Gatzemeyer et al.
9,066,579 B2 6/2015 Hess et al.
D734,614 S 7/2015 Driesen et al.
9,125,484 B2 9/2015 Gatzemeyer
D747,609 S 1/2016 Watkins
D751,295 S 3/2016 Lee et al.
D759,380 S 6/2016 Watkins
D764,176 S 8/2016 Xi et al.
D764,177 S 8/2016 Xi et al.
D777,446 S 1/2017 Xi et al.
9,572,417 B2 2/2017 Hess et al.
D780,457 S 3/2017 Jimenez et al.
D783,290 S 4/2017 Lee et al.
9,655,435 B2 5/2017 Kraemer et al.
D793,736 S 8/2017 Zavalloni
D795,419 S 8/2017 Kohler
D798,061 S 9/2017 Jimenez
9,826,822 B2 11/2017 Geiberger et al.
D813,550 S 3/2018 Xi et al.
D814,796 S 4/2018 Xi et al.
9,955,778 B2 5/2018 Xi et al.
10,004,322 B2 * 6/2018 Jungnickel ..... A46B 9/06
D824,174 S 7/2018 Altmann et al.
10,039,370 B2 8/2018 Lee et al.
D833,756 S 11/2018 Hielscher et al.
D833,757 S 11/2018 Hielscher et al.
D834,325 S 11/2018 Hielscher et al.
10,172,440 B2 1/2019 Wagstaff
10,178,907 B2 1/2019 Hohlbein
10,206,492 B2 2/2019 Gottlieb
10,238,204 B2 3/2019 Lee et al.
D849,408 S 5/2019 Bloch et al.
D851,411 S 6/2019 Wainless et al.
D854,332 S 7/2019 Hielscher et al.
D854,336 S 7/2019 Hielscher et al.
D854,835 S 7/2019 Hielscher et al.
D855,998 S 8/2019 Hielscher et al.
D860,653 S 9/2019 Xi et al.
10,426,250 B2 10/2019 Jimenez et al.
10,485,328 B2 11/2019 Jimenez et al.
D868,479 S 12/2019 Papazian
D868,480 S 12/2019 Papazian
D868,481 S 12/2019 Papazian
D868,483 S 12/2019 Papazian
D869,852 S 12/2019 Papazian
D869,853 S 12/2019 Papazian
10,548,393 B2 2/2020 Xi et al.
D877,519 S 3/2020 Xi et al.
10,582,761 B2 3/2020 Jimenez et al.
10,595,628 B2 3/2020 Jimenez et al.
D880,164 S 4/2020 Zavalloni
D881,580 S 4/2020 Smigel
D883,677 S 5/2020 Xie et al.
D886,460 S 6/2020 Xi et al.
D887,145 S 6/2020 Hu

(56) References Cited

U.S. PATENT DOCUMENTS

| | | | | |
|---|---|---|---|---|
| 10,687,925 | B2 | 6/2020 | Störkel et al. | |
| 10,743,645 | B2 | 8/2020 | Lee et al. | |
| D894,612 | S | 9/2020 | Zhang | |
| D901,183 | S | 11/2020 | Jungnickel et al. | |
| D902,600 | S | 11/2020 | Altmann et al. | |
| 10,849,416 | B2 | 12/2020 | Hohlbein | |
| 10,874,204 | B2 | 12/2020 | Langenegger et al. | |
| D919,301 | S | 5/2021 | Zhao | |
| 11,013,313 | B2 | 5/2021 | Xi et al. | |
| 11,033,096 | B2 | 6/2021 | Bloch et al. | |
| 11,103,057 | B2 | 8/2021 | Pillai et al. | |
| D932,190 | S | 10/2021 | Kraemer | |
| D933,368 | S | 10/2021 | Albay et al. | |
| D935,187 | S | 11/2021 | Hu | |
| D935,188 | S | 11/2021 | He et al. | |
| 11,224,282 | B2 | 1/2022 | Wong et al. | |
| D943,283 | S | 2/2022 | Xie et al. | |
| 11,266,226 | B2 | 3/2022 | Xie et al. | |
| D950,249 | S | 5/2022 | Albay et al. | |
| D953,039 | S | 5/2022 | Altmann et al. | |
| D953,744 | S | 6/2022 | Altmann et al. | |
| D959,843 | S | 8/2022 | Jungnickel et al. | |
| D960,583 | S | 8/2022 | Hallein et al. | |
| D961,269 | S | 8/2022 | Xie et al. | |
| D965,984 | S | 10/2022 | Lee | |
| D972,846 | S | 12/2022 | Altmann et al. | |
| D984,136 | S | 4/2023 | Albay et al. | |
| D989,492 | S | 6/2023 | Cu et al. | |
| 2001/0023516 | A1 | 9/2001 | Driesen et al. | |
| 2002/0004964 | A1 | 1/2002 | Luchino et al. | |
| 2004/0200016 | A1 | 10/2004 | Chan et al. | |
| 2006/0230563 | A1 | 10/2006 | Gavney | |
| 2007/0163064 | A1 | 7/2007 | Wong et al. | |
| 2010/0180392 | A1 | 7/2010 | Binet et al. | |
| 2011/0047736 | A1 | 3/2011 | Jimenez et al. | |
| 2011/0296642 | A1 | 12/2011 | Driesen et al. | |
| 2014/0237744 | A1 | 8/2014 | Baertschi et al. | |
| 2014/0359958 | A1* | 12/2014 | Jungnickel | A46B 9/04 15/167.1 |
| 2015/0150366 | A1 | 6/2015 | Kim et al. | |
| 2015/0327666 | A1 | 11/2015 | Hohlbein | |
| 2016/0270519 | A1* | 9/2016 | Lee | A46B 9/06 |
| 2016/0353871 | A1 | 12/2016 | Xi et al. | |
| 2017/0202348 | A1 | 7/2017 | Moskovich et al. | |
| 2017/0311711 | A1 | 11/2017 | Sorrentino | |
| 2017/0354240 | A1 | 12/2017 | Jimenez et al. | |
| 2017/0367469 | A1 | 12/2017 | Jimenez et al. | |
| 2018/0206627 | A1 | 7/2018 | Xi et al. | |
| 2019/0110585 | A1 | 4/2019 | Hohlbein | |
| 2019/0125065 | A1 | 5/2019 | Altmann et al. | |
| 2021/0227964 | A1 | 7/2021 | Liu et al. | |
| 2021/0235855 | A1 | 8/2021 | Jimenez | |
| 2021/0368973 | A1 | 12/2021 | Sprosta et al. | |
| 2022/0142348 | A1 | 5/2022 | Xie et al. | |

FOREIGN PATENT DOCUMENTS

| | | | | |
|---|---|---|---|---|
| BR | DI7102573-1 | | 1/2013 | |
| CA | 2163314 | A1 * | 6/1996 | A46B 9/04 |
| CA | 2741832 | | 5/2010 | |
| CA | 3078856 | | 10/2018 | |
| CN | 1214894 | | 4/1999 | |
| CN | 1371645 | | 10/2002 | |
| CN | 1426283 | | 6/2003 | |
| CN | 1475184 | | 2/2004 | |
| CN | 1493236 | | 5/2004 | |
| CN | 1504139 | | 6/2004 | |
| CN | 2621489 | | 6/2004 | |
| CN | 3406091 | | 11/2004 | |
| CN | 1813611 | | 8/2006 | |
| CN | 101011200 | | 8/2007 | |
| CN | 101057728 | | 10/2007 | |
| CN | 101066178 | | 11/2007 | |
| CN | 300773949 | | 5/2008 | |
| CN | 300786056 | | 6/2008 | |
| CN | 100401940 | | 7/2008 | |
| CN | 201256721 | | 6/2009 | |
| CN | 201499805 | | 6/2010 | |
| CN | 301372885 | | 11/2010 | |
| CN | 301413563 | | 12/2010 | |
| CN | 201894324 | | 7/2011 | |
| CN | 102202601 | | 9/2011 | |
| CN | 301736977 | | 11/2011 | |
| CN | 301736982 | | 11/2011 | |
| CN | 202069134 | | 12/2011 | |
| CN | 301850474 | | 3/2012 | |
| CN | 302037495 | | 8/2012 | |
| CN | 302098067 | | 10/2012 | |
| CN | 202514896 | | 11/2012 | |
| CN | 302443083 | | 5/2013 | |
| CN | 302500154 | | 7/2013 | |
| CN | 302691167 | | 12/2013 | |
| CN | 302860733 | | 7/2014 | |
| CN | 105358009 | | 2/2016 | |
| CN | 303991831 | | 1/2017 | |
| CN | 106419055 | | 2/2017 | |
| CN | 106998896 | | 8/2017 | |
| CN | 106998897 | | 8/2017 | |
| CN | 105828746 | | 10/2017 | |
| CN | 107635432 | | 1/2018 | |
| CN | 105517461 | | 6/2018 | |
| CN | 108135348 | | 6/2018 | |
| CN | 108495577 | | 9/2018 | |
| DE | 102009024923 | | 12/2010 | |
| DE | 102010014928 | | 10/2011 | |
| EM | D000061387-0001 | | 12/2003 | |
| EM | D000097415-0005 | | 2/2004 | |
| EM | D000992961-001 | | 10/2008 | |
| EM | 001165708-0002 | | 9/2009 | |
| EM | D001638636-0001 | | 1/2010 | |
| EM | D001224166-0001 | | 7/2010 | |
| EM | D001224166-0002 | | 7/2010 | |
| EM | D001235436-0001 | | 1/2011 | |
| EM | D001280820-0003 | | 7/2011 | |
| EM | D001224919-0001 | | 1/2013 | |
| EM | 001472484-0001 | | 6/2019 | |
| EM | 008266779-0004 | | 11/2020 | |
| EM | 008266779-0005 | | 11/2020 | |
| EP | 0433773 | | 6/1991 | |
| EP | 0768832 | | 4/1997 | |
| EP | 1339346 | | 9/2003 | |
| EP | 2385772 | | 11/2011 | |
| EP | 2700331 | | 2/2014 | |
| EP | 2910143 | | 8/2015 | |
| EP | 2929803 | | 10/2015 | |
| EP | 3381319 | | 10/2018 | |
| EP | 3381320 | | 10/2018 | |
| EP | 3381321 | | 10/2018 | |
| EP | 3381322 | | 10/2018 | |
| EP | 3402364 | | 11/2018 | |
| GB | 2371217 | | 7/2002 | |
| IN | 191195 | | 10/2003 | |
| IN | 197633 | | 6/2004 | |
| IN | 201790 | | 4/2005 | |
| IN | 201791 | | 4/2005 | |
| IN | 199706 | | 6/2005 | |
| IN | 203425 | | 9/2005 | |
| IN | 202093 | | 10/2005 | |
| IN | 203943 | | 10/2005 | |
| IN | 203978 | | 4/2006 | |
| IN | 206601 | | 5/2007 | |
| IN | 207535 | | 7/2007 | |
| IN | 207536 | | 7/2007 | |
| IN | 213024 | | 3/2008 | |
| IN | 213025 | | 3/2008 | |
| IN | 214437 | | 3/2008 | |
| IN | 214438 | | 3/2008 | |
| IN | 214440 | | 3/2008 | |
| IN | 214441 | | 3/2008 | |
| IN | 214442 | | 3/2008 | |
| IN | 219038 | | 6/2008 | |
| IN | 232733 | | 3/2009 | |
| IN | 194520 | | 7/2009 | |

(56) References Cited

FOREIGN PATENT DOCUMENTS

| | | |
|---|---|---|
| IN | 249094 | 10/2011 |
| JP | 2000-000117 | 1/2000 |
| JP | 2000-004945 | 1/2000 |
| JP | 2005-103184 | 4/2005 |
| JP | 2006-149419 | 6/2006 |
| JP | 2008-142371 | 6/2008 |
| JP | D1421458 | 8/2011 |
| JP | 2013-085586 | 5/2013 |
| JP | D1551400 | 6/2016 |
| JP | D1530063 | 7/2018 |
| KR | 30-0365768 | 10/2004 |
| KR | 3003868130000 | 7/2005 |
| KR | 3004421640000 | 3/2007 |
| KR | 3004585160000 | 3/2007 |
| KR | 20080095011 | 10/2008 |
| KR | 3008205200001 | 10/2015 |
| KR | 300826820001 | 11/2015 |
| KR | 3008262820001 | 11/2015 |
| KR | 300905009.0000 | 5/2017 |
| KR | 3008205150001 | 10/2021 |
| MX | E/2008/005529 | 1/2008 |
| MX | 28473 | 6/2009 |
| MX | E/2011/032927 | 5/2011 |
| PA | E/2003/049205 | 11/2003 |
| RU | 45898 | 6/2005 |
| RU | 267286 | 1/2006 |
| RU | 52229 | 3/2006 |
| RU | 83717 | 6/2009 |
| RU | 00126666 | 8/2021 |
| TW | 592455 | 6/2004 |
| TW | D153413 | 5/2013 |
| TW | D174985 | 4/2016 |
| TW | D174986 | 4/2016 |
| TW | D202957 | 3/2020 |
| TW | D202958 | 3/2020 |
| TW | D202959 | 3/2020 |
| WO | 2001/032053 | 5/2001 |
| WO | 2001/082741 | 11/2001 |
| WO | 2002/045617 | 6/2002 |
| WO | 2004/028235 | 4/2004 |
| WO | 2004/080237 | 9/2004 |
| WO | 2004/093718 | 11/2004 |
| WO | 2004/062573 | 12/2004 |
| WO | 2004/112538 | 12/2004 |
| WO | 2005/087046 | 9/2005 |
| WO | 2006/062187 | 6/2006 |
| WO | 2006/062265 | 6/2006 |
| WO | 2006/107123 | 10/2006 |
| WO | 2007/016802 | 2/2007 |
| WO | 2007/043848 | 4/2007 |
| WO | 2007/073045 | 6/2007 |
| WO | 2007/104381 | 9/2007 |
| WO | 2008/022480 | 2/2008 |
| WO | 2008/060005 | 5/2008 |
| WO | 2008/111792 | 9/2008 |
| WO | 2008/138158 | 11/2008 |
| WO | 2009/084637 | 7/2009 |
| WO | 2010/069917 | 6/2010 |
| WO | 2010/069919 | 6/2010 |
| WO | 2010/119688 | 10/2010 |
| WO | 2011/014000 | 2/2011 |
| WO | 2014/098853 | 6/2014 |
| WO | 2016/105372 | 6/2016 |
| WO | 2017/044072 | 3/2017 |
| WO | 2017/182355 | 10/2017 |
| WO | 2018/193947 | 10/2018 |
| WO | 2020/118604 | 6/2020 |

OTHER PUBLICATIONS

Colgate, Colgate CushionClean Kids Toothbrush(Random Color) 1pc, retrieved Jun. 15, 2022 from Mannings Online Store, https://www.mannings.com.hk/colgate-cushion-clean-kids-toothbrush-random-color-1pc/p/258426#, pp. 1-4.

International Search Report and Written Opinion of the International Searching Authority in International Application No. PCT/CN2018/120836, mailed Sep. 18, 2019.

International Search Report and Written Opinion of the International Searching Authority in International Application No. PCT/CN2018/120838, mailed Sep. 11, 2019, pp. 1-14.

premusa.com, Premier Dental "Premier Dental 2pro® Disposable Prophy Angle," http://www.premusa.com/product/hygienepreventative/2pro/, retrieved Dec. 6, 2017, pp. 1-3.

smilemakers.com, "100 Funimals ™ Disposable Prophy Angles—Dental Toys from SmileMakers," https://www.smilemakers.com/funimals-disposable-prophy-angles.html?gclid=CjwKCAiApJnRBRBIEiwAPTgmxCGK37ZmCA9UT1RHZi7uOtVbBA4osLk6OSYWESGpONqourJ9cTP5xoC2c4QAvD_BwE, retrieved Dec. 6, 2017, pp. 1-2.

Colgate Fluffy Paw Toothbrush, retrieved ( Jul. 18, 2023) retrieved from internet, https://www.mannings.com.hk/colgate-fluffy-paw-toothbrush-1pc-random-colour/p/474676 (Year 2023).

Colgate Optic White Pro Series Charcoal Toothbrushes, posted Jan. 13, 2023 [online], [retrieved Jul. 18, 2023]. Retrieved from internet, https://www.amazon.com/dp/B0BQPSB3GG (Year: 2023).

Colgate Renewal Manual Toothbrush, 2 Count [on-line]. [Publication date Feb. 9-21, 2023] [Internet retrieval date Sep. 21, 2023], https://www.amazon.com/Colgate-Renewal-Manual-Toothbrushes-Massage/dp/B08M9T56H7/ref=asc_df_B08M9T56H7?tag=bingshoppinga-20&linkCode=df0&hvadid=79920866478923&hvnetw=o&hvqmt=e&hvbmt=be&hvdev=c&hvlocint=&hvlocphy=&hvtargid=pla-4583520396658703&psc=1 (Year:2023).

Philips Sonicare Airfloss Ultra, posted Sep. 22, 2017 [online], [retrieved Jul. 18, 2023]. Retrieved from internet, https://www.amazon.cn/dp/BOOSDFFYU0/?th=1 (Year:2017).

YNG Disp Prophy Angle Classic, posted Aug. 25, 2018 [online], [retrieved Jul. 18, 2023]. Retrieved from internet, https:/www.amazon.com/dp/B07GTD5DJL/ (Year:2018).

* cited by examiner

ORAL CARE IMPLEMENT

CROSS-REFERENCE TO RELATED APPLICATIONS

The present application is a continuation of U.S. patent application Ser. No. 16/619,122, filed Dec. 4, 2019, which is a national stage entry under 35 U.S.C. § 371 of PCT/CN2018/120836, filed Dec. 13, 2018, the entireties of which are incorporated herein by reference.

BACKGROUND

Myriad implements and devices for maintaining oral health are known. For example, toothbrushes of both the manual and powered variety, floss, dentifrices, applicators, agents, and the like are all known to provide different benefits in the oral cavity. The main components used for cleaning of the teeth are the cleaning elements of a toothbrush, which may include filament bristles as well as rubber elements known in the art as lamella. Different toothbrush users desire different mouthfeels during toothbrushing. Specifically, some people prefer a harder brush that provides the users with confidence that the cleaning elements are removing debris from the teeth. However, other people find such hard brushes to cause discomfort and prefer softer cleaning elements and a softer mouthfeel during brushing. Thus, a need exists for a tooth cleaning implement that provides the desired mouthfeel while also adequately cleaning plaque and other debris from the teeth and gums.

BRIEF SUMMARY

The present invention is directed to an oral care implement having a head with a plurality of cleaning elements coupled thereto and extending therefrom. In the exemplified embodiment, the cleaning elements comprise a plurality of bristle tufts each consisting of a plurality of filaments. In one aspect, the invention includes a first bristle tuft having inner and outer filaments with the outer filaments being taller than the inner filaments and a second bristle tuft having inner and outer filaments with the outer filaments being shorter than the inner filaments. In another aspect, the invention includes a bristle tuft having inner and outer filaments with the inner filaments being either taller or shorter than the outer filaments, and whereby distal ends of the inner and outer filaments are angled relative to an axis of the bristle tuft.

In one aspect, the invention may be an oral care implement comprising: a head comprising a front surface; a first bristle tuft extending from the front surface of the head, the first bristle tuft comprising a plurality of first outer filaments and a plurality of first inner filaments, the first outer filaments surrounding the first inner filaments, and wherein each of the first outer filaments is taller than each of the first inner filaments; and a second bristle tuft extending from the front surface of the head, the second bristle tuft comprising a plurality of second outer filaments and a plurality of second inner filaments, the second outer filaments surrounding the second inner filaments, and wherein each of the second outer filaments is shorter than each of the second inner filaments.

In another aspect, the invention may be an oral care implement comprising: a head comprising a front surface; a first bristle tuft coupled to the head and comprising a first longitudinal axis, the first bristle tuft comprising a plurality of first outer filaments that form a sheath portion of the first bristle tuft and a plurality of first inner filaments that form a core portion of the first bristle tuft, the sheath portion surrounding the core portion, and wherein either: (1) each of the first outer filaments is taller than each of the first inner filaments; or (2) each of the first outer filaments is shorter than each of the first inner filaments; and wherein a distal end of the sheath portion of the first bristle tuft collectively forms a first outer distal surface of the first bristle tuft and a distal end of the core portion of the first bristle tuft forms a first inner distal surface of the first bristle tuft; and wherein the first outer distal surface of the first bristle tuft is oriented at a first oblique angle relative to the first longitudinal axis of the first bristle tuft and the first inner distal surface of the first bristle tuft is oriented at a second oblique angle relative to the first longitudinal axis of the first bristle tuft.

In yet another embodiment, the invention may be an oral care implement comprising: a head comprising a front surface having a perimeter portion and a central portion that is surrounded by the perimeter portion; a plurality of first bristle tufts coupled to the head and located along the perimeter portion of the front surface of the head; a plurality of second bristle tufts coupled to the head and located along the central portion of the front surface of the head; and wherein each of the first bristle tufts extends from the front surface of the head to an inclined terminal end that slopes upwardly towards the plurality of second bristle tufts, and wherein each of the second bristle tufts extends from the front surface of the head to an inclined terminal end that slopes upwardly towards the plurality of first bristle tufts.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
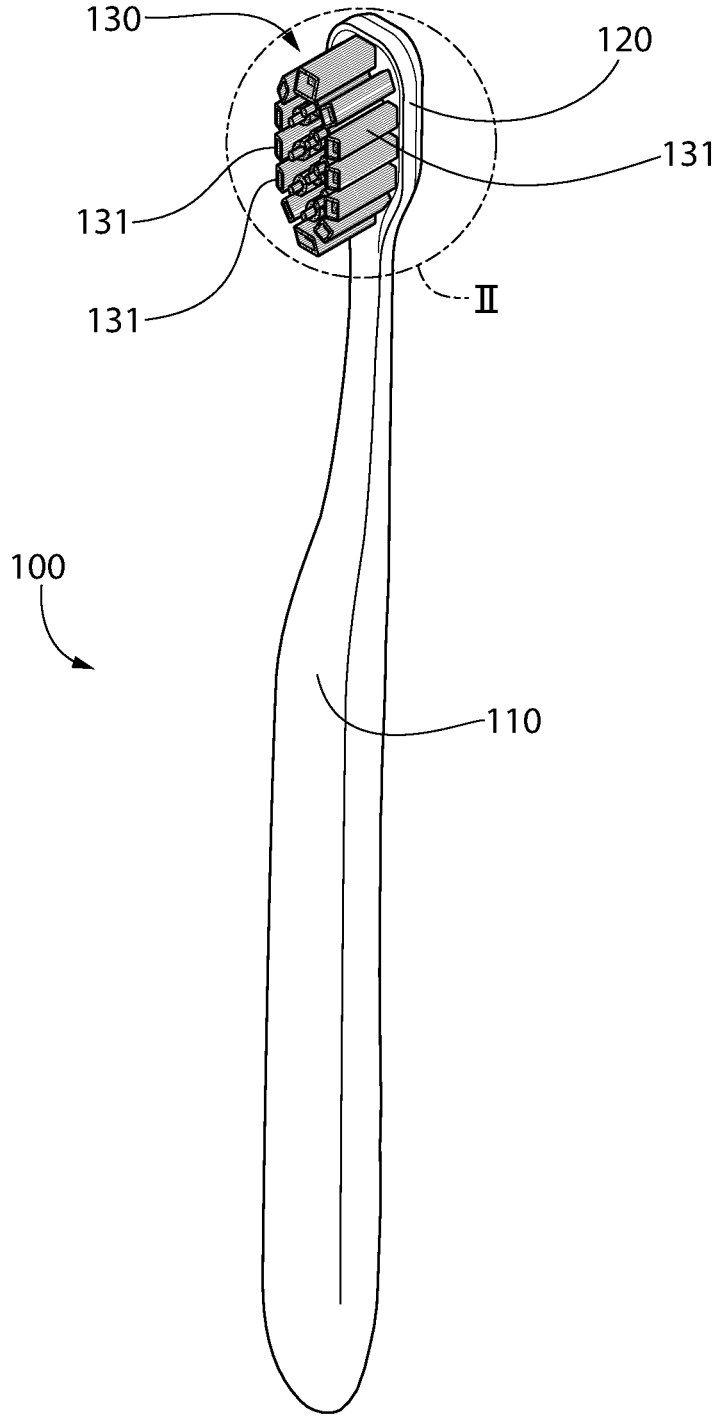
FIG. 1 is perspective view of an oral care implement in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
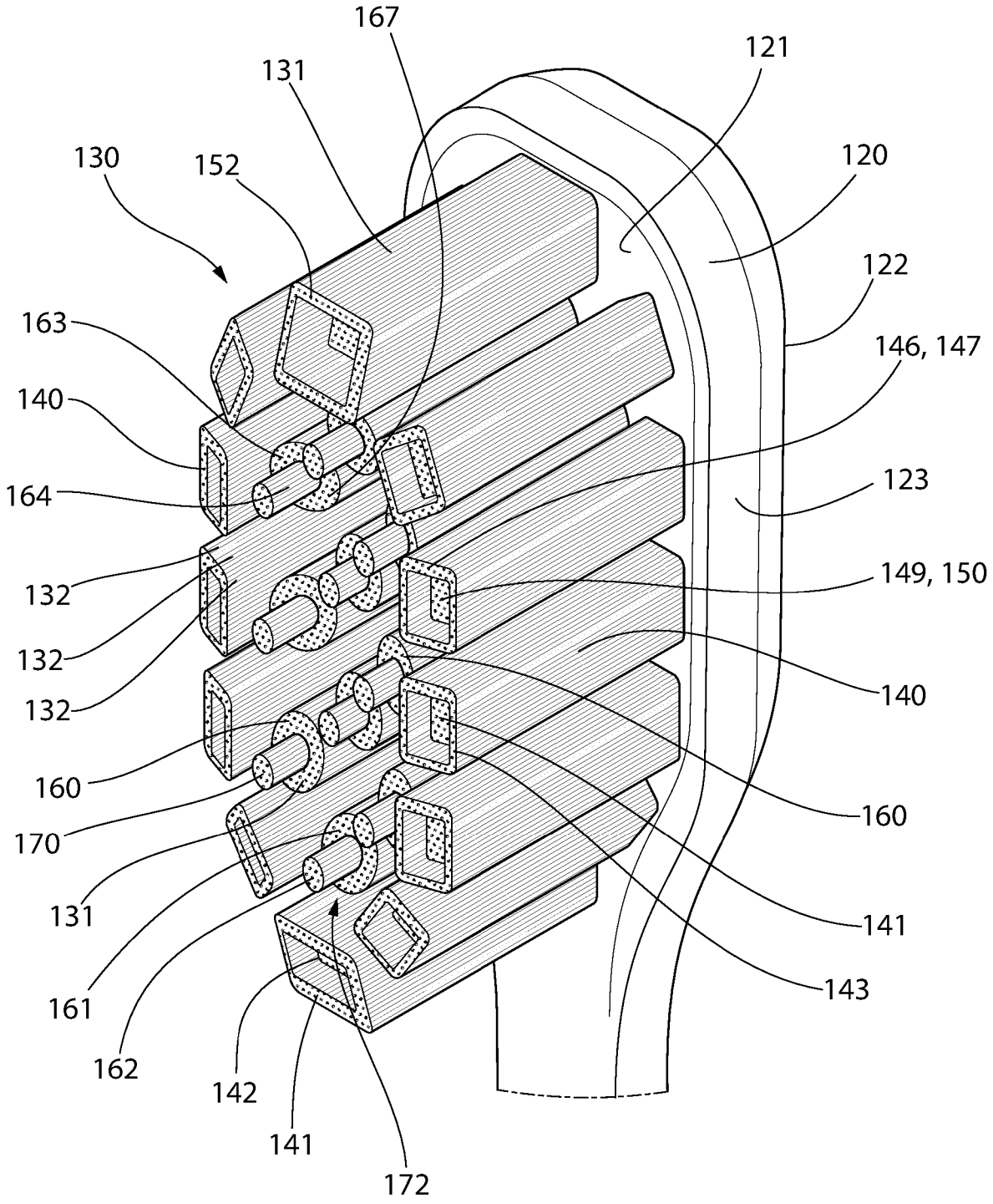
FIG. 2 is a close-up view of a head of the oral care implement depicted as area II of FIG. 1.
Figure 3:
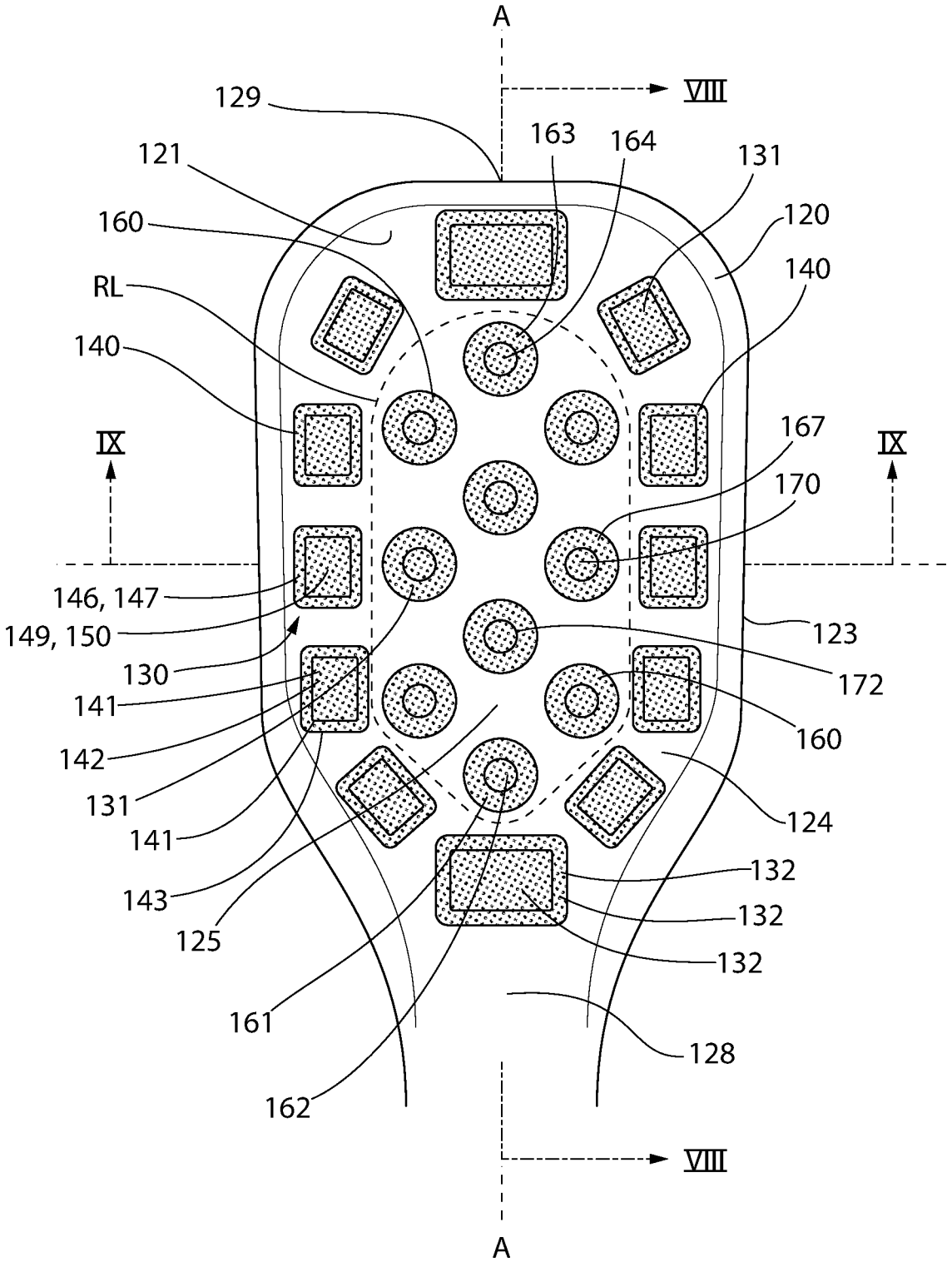
FIG. 3 is a front view of the head of the oral care implement of FIG. 1.
Figure 5:
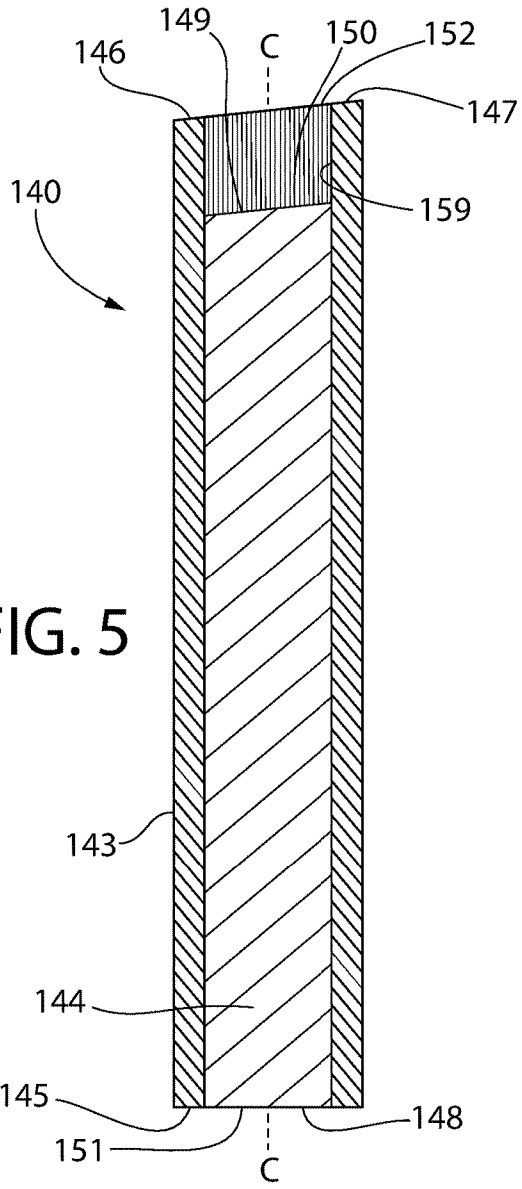
FIG. 5 is a cross-sectional view taken along line V-V of FIG. 4.
Figure 4:
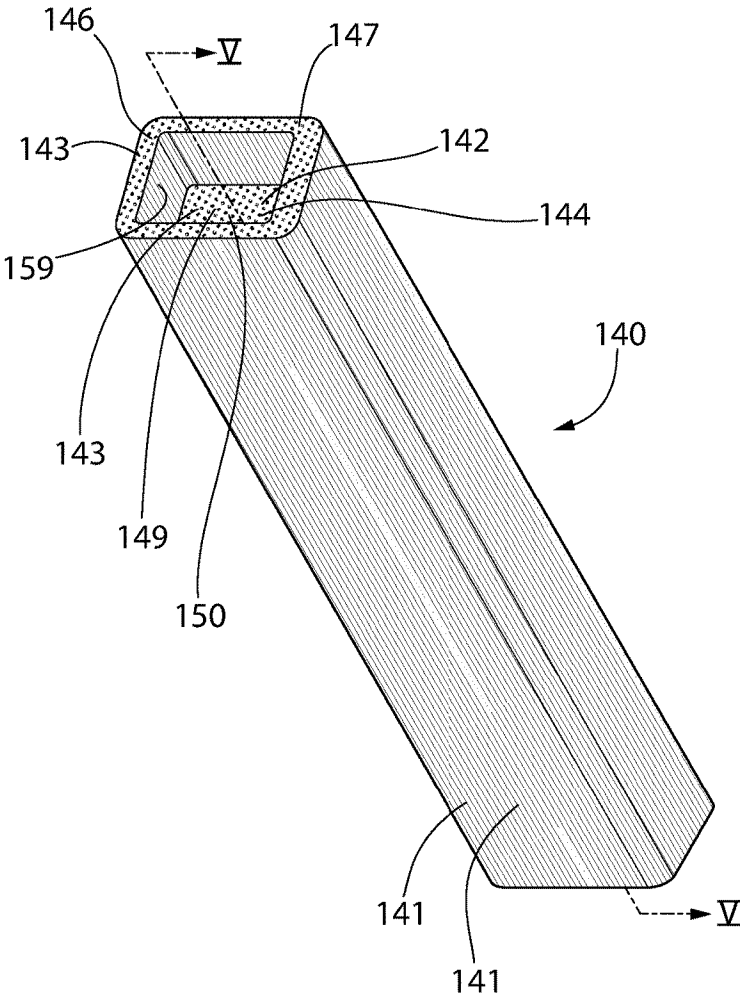
FIG. 4 is a perspective view of a first bristle tuft of the oral care implement of FIG. 1.
Figure 7:
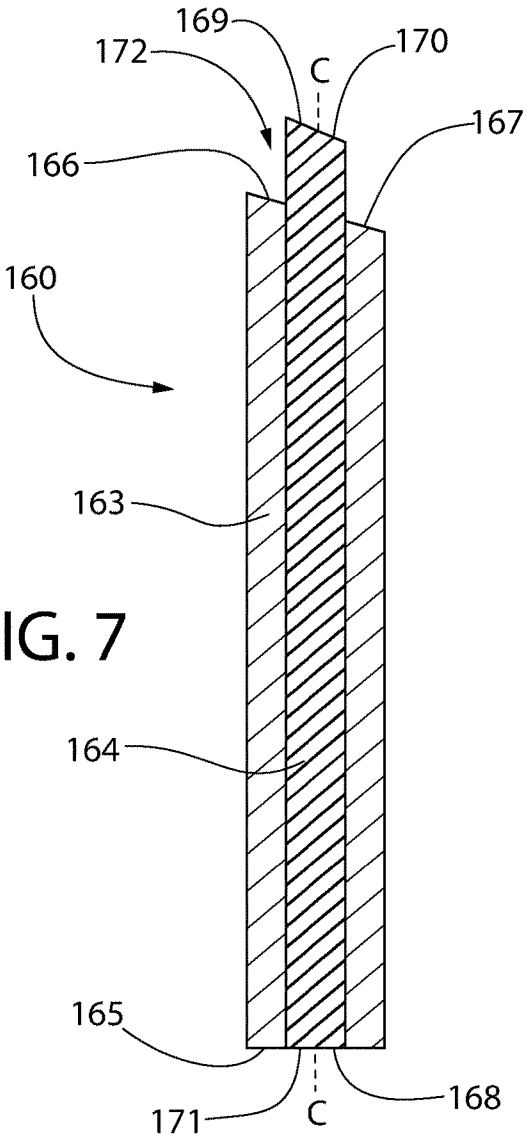
FIG. 7 is a cross-sectional view taken along line VII-VII of FIG. 6.
Figure 6:
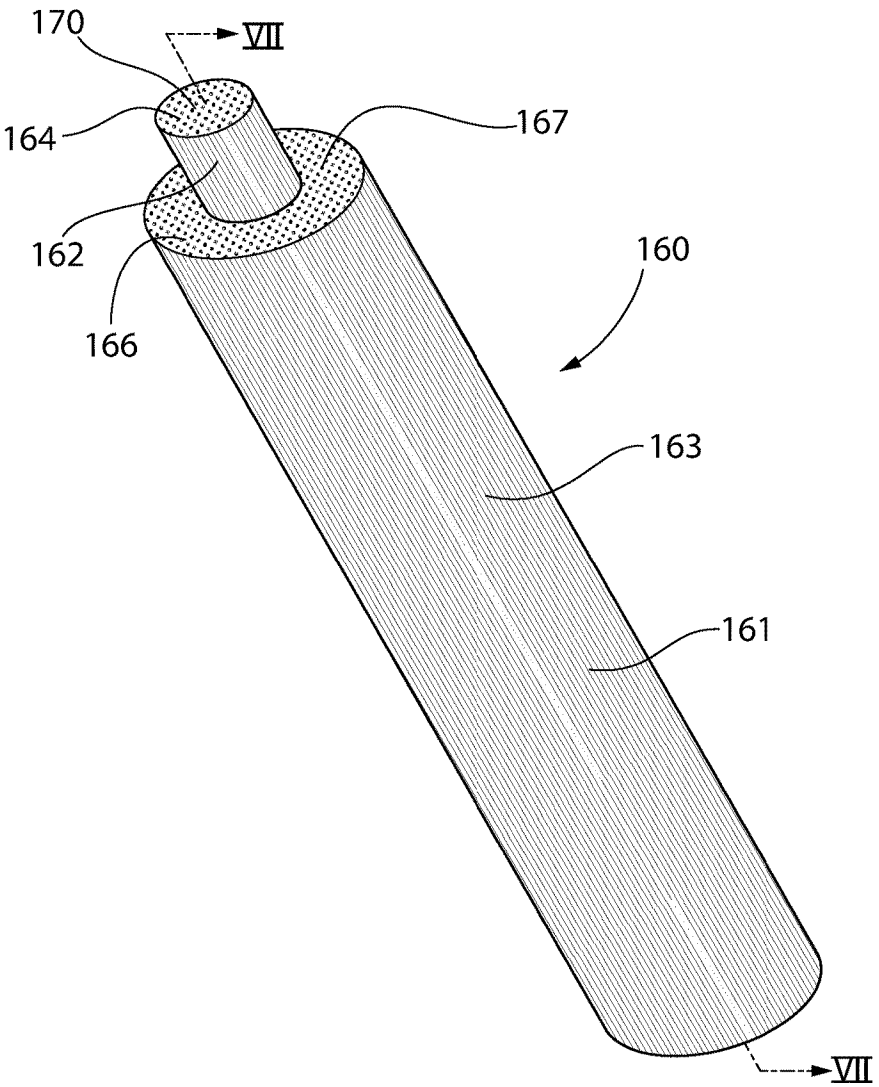
FIG. 6 is a perspective view of a second bristle tuft of the oral care implement of FIG. 1.

Referring first to FIGS. 1-3, an oral care implement 100 is illustrated in accordance with an embodiment of the present invention. In the exemplified embodiment, the oral care implement 100 is a manual toothbrush. However, the invention is not to be so limited in all embodiments and in other embodiments the oral care implement 100 could be a powered toothbrush that either vibrates the cleaning elements or moves them in a rotational or linear back-and-forth manner. The oral care implement 100 is generally intended for cleaning of a user's oral cavity, specifically the teeth and gums, although it could certainly have other uses as well such as general cleaning or the like.

The oral care implement 100 generally comprises a handle 110 and a head 120. The handle 110 and the head 120 may be formed as an integral, monolithic structure during an injection molding process. Thus, in some embodiments the handle 110 and the head 120 may be formed from a rigid plastic material, such as those mentioned below. Of course, the invention is not to be limited by this structure in all embodiments and in alternative embodiments the head 120 may be detachable from the handle 110 so that the head 120 is a refill head as that term is commonly known in the art. In such embodiments it may be possible to replace the head 120 with a new head while maintaining the same handle 110. The general shape of the handle 110 and the head 120 is not to be limited to that which is depicted in the drawings in all embodiments, with the drawings merely depicting one exemplary and non-limiting embodiment.

The handle 110 is an elongated structure that provides the mechanism by which the user can hold and manipulate the oral care implement 100 during use. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims. In the exemplified embodiment, the handle 110 and the head 120 are formed of a rigid plastic material, such as, for example without limitation, polymers and copolymers of ethylene, propylene, butadiene, vinyl compounds, and polyesters such as polyethylene terephthalate. Of course, the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user. Moreover, the head 120 could also include a resilient material such as a thermoplastic elastomer on its rear surface to provide a tongue or check cleaning function.

The head 120 extends from a proximal end 128 to a distal end 129 and comprises a longitudinal axis A-A that extends between the proximal and distal ends 128, 129. The head 120 also comprises a transverse axis B-B that is perpendicular to the longitudinal axis A-A and equidistant to the proximal and distal ends 128, 129 of the head 120. The head 120 further comprises a front surface 121 and a rear surface 122 opposite the front surface 121. Furthermore, the head 120 comprises a lateral surface 123 that extends between the front and rear surfaces 121, 122. The transverse axis B-B of the head 120 is oriented so as to intersect the lateral surface 123 of the head 120 twice while being perpendicular to the longitudinal axis A-A.

The front surface 121 of the head 120 comprises a perimeter portion 124 and a central portion 125. The perimeter portion 124 of the front surface 121 of the head 120 surrounds the central portion 125 of the front surface 121 of the head 120. The perimeter portion 124 is an annular portion of the front surface 121 of the head 120 that extends from the lateral surface 123 to the central portion 125. In the exemplified embodiment, a dashed line marked RL is provided in FIG. 3 to represent the dividing line between the perimeter and central portions 124, 125 of the front surface 121 of the head 120. However, it should be appreciated that the perimeter and central portions 124, 125 of the front surface 121 of the head 120 do not have predetermined surface areas, and thus the exact location of the line RL could be changed from that illustrated and still fall within the scope of the invention set forth herein. Thus, the surface area, width, diameter, etc. of the perimeter and central portions 124, 125 are not to be particularly limited to the exemplified embodiment shown in the drawings. The perimeter portion 124 is described above as being an annular portion, but it is not limited to being circular in all embodiments and could take on other shapes. Similarly, the central portion 125 is illustrated in the drawings as being oval in shape, but it could be circular, square, triangular, or other shapes in other embodiments. Thus, various permutations are possible so long as the perimeter portion 124 is a portion of the front surface 121 of the head 120 that surrounds the central portion 125 of the front surface 121 of the head 120.

The oral care implement 100 further comprises a plurality of cleaning elements 115 coupled to and extending from the head 120. The plurality of cleaning elements 130 could be coupled to the head using any technique now known or later discovered, including staples, anchor-free tufting (AFT), in-mold tufting (IMT), PTt technology, or the like. In staple technology, the bristle tufts are folded into a U shape and then a staple is used to secure the bristle tufts within a tuft hole. In AFT technology, the bristle tufts are inserted through holes in a head plate and the ends of the tufts that extend from the back of the head plate are melted together to form a layer of bristle material that lies adjacent to the rear surface of the head plate. This prevents the bristle tufts from being pulled back through the tuft holes. The head plate is then secured to the head. In PTt technology, the bristle filaments are arranged in tufts and then melted together to form tufts having a mushroom shaped end. The tufts with the mushroom shaped ends are then inserted in pre-cored holes of a toothbrush head. Then, pressure and heat is applied to the toothbrush head, which causes the surface of the toothbrush head to reshape itself to enclose the mushroom-shaped ends of the tufts, holding them firmly. Thus, the invention is not intended to be particularly limited by the manner in which the cleaning elements 130 are coupled to the head 120. However, the cleaning elements 130 should be coupled to the head 120 in such a manner so that they extend from the front surface 121 of the head 120. The cleaning elements 130 could extend perpendicularly from the front surface 121 of the head 120 or at an angle relative to the front surface 121 of the head 120, or combinations thereof, as may be desired.

In the exemplified embodiment, the plurality of cleaning elements 130 comprises a plurality of bristle tufts 131, each of which comprises a plurality of filament bristles 132. Such filament bristles 132 may be end-rounded, tapered, spiral, bi-core, core-sheath, or of any other type now known or later developed. The filament bristles 132 may be formed from nylon or other well-accepted materials commonly used for forming toothbrush bristles. For example, the filament bristles 132 may be made from animal hair or other natural materials, nylon-polyester blends, or other plastic materials. The filament bristles 132 may also have any desired thickness/diameter or different filament bristles 132 may have different thicknesses/diameters, ranging from 4 mils to 9 mils, and more specifically 5 mils to 7 mils. It may also be possible for some of the cleaning elements 130 to be formed from a resilient material, such as rubber, thermoplastic elastomer, or the like. However, in some preferred embodiments the cleaning elements 130 do not include any such resilient or rubber elements, but rather all of the cleaning elements 130 are bristle tufts 131 comprising (or consisting of) filament bristles 132.

The plurality of bristle tufts 131 comprises a plurality of first bristle tufts 140 coupled to the head 120 and extending from the front surface 121 of the head 120 and a plurality of second bristle tufts 160 coupled to the head 120 and extending from the front surface 121 of the head 120. In the exemplified embodiment, the cleaning elements 130 of the oral care implement 100 consist entirely of the first bristle tufts 140 and the second bristle tufts 160, there being no other types of bristle tufts or cleaning elements provided on the head 120. Of course, in other embodiments the first and second bristle tufts 140 may be intermixed with other types of cleaning elements as noted herein. Although in the exemplified embodiment there are a plurality of each of the first and second bristle tufts 140, 160, the invention is not to be so limited and in other embodiments the oral care implement 100 may include one or more of the first bristle tufts 140 and one or more of the second bristle tufts 160. In still other embodiments, the oral care implement 100 may include one or more of the first bristle tufts 140 and none of the second bristle tufts 160 and in yet other embodiments the oral care implement 100 may include one or more of the second bristle tufts 160 and none of the first bristle tufts 140.

In the exemplified embodiment, each of the first bristle tufts 140 is located or positioned along the perimeter portion 124 of the front surface 121 of the head 120. Furthermore, in the exemplified embodiment each of the second bristle tufts 160 is located or positioned along the central portion 125 of the front surface 121 of the head 120. In fact, in the exemplified embodiment there are only first bristle tufts 140 along the perimeter portion 124 and there are only second bristle tufts 160 along the central portion 125. Thus, the first bristle tufts 140 are positioned in such a way so as to surround the second bristle tufts 160. Specifically, the first bristle tufts 140 are positioned in a spaced apart manner along the perimeter portion 124 of the front surface 121 of the head 120 with the first bristle tufts 140 collectively surrounding the central portion 125. The second bristle tufts 160 are positioned in a spaced apart manner along the central portion 125 of the front surface 121 of the head 120 and are thereby surrounded by the first bristle tufts 140. Stated another way, the first bristle tufts 140 are arranged along a loop that surrounds the central portion 125 of the front surface 121 of the head 120 and surrounds the second bristle tufts 160 that are located along the central portion 125 of the front surface 121 of the head 120.

In the exemplified embodiment, some of the first bristle tufts 140 are directly adjacent to one of the second bristle tufts 160. Thus, despite the first bristle tufts 140 being located in the perimeter portion 124 and the second bristle tufts 160 being located in the central portion 125, the first and second bristle tufts 140, 160 are still positioned adjacent to one another. In some embodiments, at least one of the first bristle tufts 140 is directly adjacent to one of the second bristle tufts 160 with there being no other bristle tufts located therebetween. In fact, in the exemplified embodiment every single one of the first bristle tufts 140 is directly adjacent to one of the second bristle tufts 160, although this is not required in all embodiments and variations may be possible within the scope of the invention described herein.

In other embodiments, the positioning of the first and second bristle tufts 140, 160 may be flipped, as shown and described in greater detail below with reference to FIGS. 10-12. In still other embodiments, the first and second bristle tufts 140, 160 could be intermixed along the perimeter and central portions 124, 125 of the front surface 121 of the head 120 such that both of the perimeter and central portions 124, 125 may have one or more of the first and second bristle tufts 140, 160 located therealong, as shown and described in greater detail below with reference to FIGS. 13-15.

Referring to FIGS. 2-5, the first bristle tufts 140 will be described. Each of the first bristle tufts 140 has a similar structure to one another, said structure being described herein below. Other features of the first bristle tufts 140, such as their heights/lengths, diameters/thicknesses, the style or type of filament bristles included therein, the thickness or diameter of the filament bristles included therein, the specific angle of the distal end, or the like may differ from one another, but the description provided below is applicable to each of the first bristle tufts 140. Thus, although the description below will be directed to one of the first bristle tufts 140, it should be appreciated that it is applicable to each of the first bristle tufts 140.

The first bristle tufts 140 comprise a plurality of first outer filaments 141 and a plurality of first inner filaments 142. The plurality of first outer filaments 141 collectively surround the plurality of first inner filaments 142. Thus, the plurality of first outer filaments 141 collectively form a sheath portion 143 of the first bristle tufts 140 and the plurality of first inner filaments 142 collectively form a core portion 144 of the first bristle tufts 140. In the exemplified embodiment, the sheath portion 143 of the first bristle tufts 140 has a rectangular ring-like shape and the core portion 144 of the first bristle tufts 140 has a rectangular cross-sectional shape. However, the invention is not to be so limited in all embodiments and the sheath portion 143 may have a circular ring-like shape, a triangular ring-like shape, or any other desired geometry with the core portion 144 having a similar cross-sectional shape that fits within the open area defined by the sheath portion 143. Thus, the overall shape and transverse cross-sectional shape of the first bristle tufts 140 and the sheath and core portions 143, 144 thereof is not to be limiting of the present invention for all embodiments.

In the exemplified embodiment, there is no gap or spacing between the first outer filaments 141 and the first inner filaments 142 (or between an inner surface of the sheath portion 143 and an outer surface of the core portion 144), other than the natural spacing that occurs between bristle filaments in a bristle tuft. Thus, in some embodiments the only distinguishing feature between the sheath portion 143 and the core portion 144 is the length or height of the bristle filaments within that particular portion of the first bristle tuft 140, as described in more detail below. Thus, although different hatch line styles are used to illustrate the sheath portion 143 and the core portion 144, it should be appreciated that the first outer filaments 141 that form the sheath portion 143 and the first inner filaments 142 that form the core portion 144 may be identical other than their heights/lengths as described herein. In other embodiments, the first outer filaments 141 and the first inner filaments 142 may differ in other ways, such as thickness/diameter, color, material, or the like.

The sheath portion 143 of the first bristle tuft 140 extends from a bottom end 145 that is located within a tuft hole in the head 120 in the completed oral care implement 100 to a distal end 146. The distal end 146 of the sheath portion 143 of the first bristle tuft 140 forms a first outer distal surface 147 of the first bristle tuft 140. The core portion 144 of the first bristle tuft 140 extends from a bottom end 148 that is located within a tuft hole in the head 120 in the completed oral care implement 100 to a distal end 149. The distal end 149 of the core portion 144 of the first bristle tuft 140 forms a first inner distal surface 150 of the first bristle tuft 140.

In the exemplified embodiment, each of the first outer filaments 141 is taller than each of the first inner filaments 142. Thus, in the exemplified embodiment the sheath portion 143 of the first bristle tuft 140 is taller than the core portion 144 of the first bristle tuft 140. Stated another way, the first outer distal surface 147 of the first bristle tuft 140 is axially offset from the first inner distal surface 150 of the first bristle tuft 140. This is true despite the fact that in the exemplified embodiment the first outer filaments 141 are not all the same height and the first inner filaments 142 are not all the same height. Thus, in the exemplified embodiment the tallest of the first inner filaments 142 is still shorter than the shortest of the first outer filaments 141 so that each of the first inner filaments 142 is shorter than each of the first outer filaments 141. Thus, no portion of the first inner distal surface 150 of the first bristle tuft 140 extends beyond the first outer distal surface 147 of the first bristle tuft 140. The height of the various filaments for purposes of determine which filaments are taller or shorter when compared to one another is measured from the front surface 121 of the head 120 to a distal end of the filament, which is the portion of the filament located furthest from the front surface 121 of the head 120.

The first inner distal surface 150 of the first bristle tuft 140 formed by the core portion 144 of the first bristle tuft 140 is recessed relative to the first outer distal surface 147 of the first bristle tuft 140 formed by the sheath portion 143 of the first bristle tuft 140. This forms a small pocket or cavity within the first bristle tuft 140 between the first inner distal surface 150 of the first bristle tuft 140 and an inner surface 159 of the portion of the sheath portion 143 that extends from the first inner distal surface 150 of the first bristle tuft to the first outer distal surface 147 of the first bristle tuft 140. In some aspects, the first bristle tuft 140, or a portion thereof, may be cup-shaped due to this difference in height between the sheath portion 143 and the core portion 144.

The first bristle tuft 140 extends from a bottom end 151 (formed by the bottom ends 145, 148 of the sheath and core portions 143, 144) to a terminal end 152 along a longitudinal axis C-C. In the exemplified embodiment, the terminal end 152 of the first bristle tuft 140 is formed by the first outer distal surface 147 of the first bristle tuft 140 because the first inner distal surface 150 of the first bristle tuft 140 is recessed relative to the first outer distal surface 147 of the first bristle tuft 140. Thus, the terminal end 152 of the first bristle tuft 140 is formed by the distal ends of the filament bristles 141 that extend furthest from the head 120.

In the exemplified embodiment, the first outer distal surface 147 of the first bristle tuft 140 is oriented at an oblique angle relative to the longitudinal axis C-C of the first bristle tuft 140. Similarly, in the exemplified embodiment the first inner distal surface 150 of the first bristle tuft 140 is oriented at an oblique angle relative to the longitudinal axis C-C of the first bristle tuft 140. In the exemplified embodiment, the first outer distal surface 147 of the first bristle tuft 140 is parallel to the first inner distal surface 150 of the first bristle tuft 140. Thus, in the exemplified embodiment the first inner distal surface 150 of the first bristle tuft 140 and the first outer distal surface 147 of the first bristle tuft 140 are oriented at the same oblique angle relative to the longitudinal axis C-C. The exact oblique angle is not to be limiting of the present invention in all embodiments, but could be in a range of 70-89° in some embodiments, 75-89° in some embodiments, 80-89° in some embodiments, 80-85° in some embodiments, or the like. In alternative embodiments, the first inner and outer distal surfaces 147, 150 of the first bristle tuft 140 may be oriented at different oblique angles relative to the longitudinal axis C-C. In still other embodiments, at least one, or both, of the first inner and outer distal surfaces 147, 150 of the first bristle tuft 140 may be oriented perpendicular to the longitudinal axis C-C.

In the exemplified embodiment, the first outer distal surface 147 of the first bristle tuft 140 is planar, meaning that it lies in a plane. Similarly, the first inner distal surface 150 of the first bristle tuft 140 is planar, meaning that it lies in a plane. These planes are parallel in the exemplified embodiment but need not be in all embodiments as described herein above. Of course, the first outer and inner distal surfaces 147, 150 of the first bristle tuft 140 may not be planar in all embodiments, but may instead be rounded, wavy, or the like.

Referring to FIGS. 2, 3, 6, and 7, the second bristle tufts 160 will be described. Each of the second bristle tufts 160 has a similar structure to one another, said structure being described herein below. Other features of the second bristles tufts 160 may differ from one another, but the description provided below is applicable to each of the second bristle tufts 160. Thus, although the description below will be directed to one of the second bristle tufts 140, it should be appreciated that it is applicable to each of the second bristle tufts 160.

The second bristle tufts 160 comprise a plurality of second outer filaments 161 and a plurality of second inner filaments 162. The plurality of second outer filaments 161 collectively surround the plurality of second inner filaments 162. Thus, the plurality of second outer filaments 162 collectively form a sheath portion 163 of the second bristle tufts 160 and the plurality of second inner filaments 162 collectively form a core portion 164 of the second bristle tufts 160. In the exemplified embodiment, the sheath portion 163 of the second bristle tufts 160 has a circular ring-like shape and the core portion 164 of the second bristle tufts 160 have a circular cross-sectional shape. However, the invention is not to be so limited in all embodiments and the sheath portion 163 may have a rectangular ring-like shape, a triangular ring-like shape, or any other desired geometry with the core portion 164 having a similar cross-sectional shape that fits within the open area defined by the sheath portion 163. Thus, the overall shape and transverse cross-sectional shape of the second bristle tufts 160 and the sheath and core portions 163, 164 thereof is not to be limiting of the present invention for all embodiments.

In the exemplified embodiment, there is no gap or spacing between the second outer filaments 161 and the second inner filaments 162 (or between an inner surface of the sheath portion 163 and an outer surface of the core portion 164), other than the natural spacing that occurs between bristle filaments in a bristle tuft. Thus, in some embodiments the only distinguishing features between the sheath portion 163 and the core portion 164 of the second bristle tuft 160 is the length of height of the bristle filaments within that particular portion of the second bristle tuft 160, as described in more detail below. Thus, although different hatch line styles are used to illustrate the sheath portion 163 and the core portion 164, it should be appreciated that the second outer filaments 161 that form the sheath portion 163 and the second inner filaments 162 that form the core portion 164 may be identical other than their heights/lengths as described herein. In other embodiments, the second outer filaments 161 and the second inner filaments 162 may differ in other ways, such as thickness/diameter, color, material, or the like.

The sheath portion 163 of the second bristle tuft 160 extends from a bottom end 165 that is located within a tuft hole in the head 120 in the completed oral care implement 100 to a distal end 166. The distal end 166 of the sheath portion 163 of the second bristle tuft 160 forms a second outer distal surface 167 of the second bristle tuft 160. The core portion 164 of the second bristle tuft 160 extends from a bottom end 168 that is located within a tuft hole in the head 120 in the completed oral care implement 100 to a distal end 169. The distal end 169 of the core portion 164 of the second bristle tuft 160 forms a first inner distal surface 170 of the second bristle tuft 160.

In the exemplified embodiment, each of the second outer filaments 161 is shorter than each of the second inner filaments 162. Stated another way, the second outer distal surface 167 of the second bristle tuft 160 is axially offset from the second inner distal surface 170 of the second bristle tuft 160. This is true despite the fact that in the exemplified embodiment the second outer filaments 161 are not all the same height and the second inner filaments 162 are not all the same height. Thus, in the exemplified embodiment the tallest of the second outer filaments 161 is still shorter than the shortest of the second inner filaments 162 so that each of the second outer filaments 161 is shorter than each of the second inner filaments 161. Thus, no portion of the second outer distal surface 167 of the second bristle tuft 160 extends beyond the second inner distal surface 170 of the second bristle tuft 160.

The second inner distal surface 170 of the second bristle tuft 160 formed by the core portion 164 of the second bristle tuft 160 extends further from the front surface 121 of the head 120 than the second outer distal surface 167 of the second bristle tuft 160 formed by the sheath portion 163 of the second bristle tuft 160. The second bristle tuft 160 extends from a bottom end 171 (formed by the bottom ends 165, 168 of the sheath and core portions 163, 164) to a terminal end 172 along a longitudinal axis D-D. In the exemplified embodiment, the terminal end 172 of the second bristle tuft 160 may be considered to be formed by the second inner distal surface 170 of the second bristle tuft 160 because it extends furthest from the head 120. In other embodiments, the terminal end 172 of the second bristle tuft 160 may be used to refer to the combination of the second inner distal surface 170 and the second outer distal surface 167 of the second bristle tuft 160.

In the exemplified embodiment, the second outer distal surface 167 of the second bristle tuft 160 is oriented at an oblique angle relative to the longitudinal axis D-D of the second bristle tuft 160. Similarly, in the exemplified embodiment the second inner distal surface 170 of the second bristle tuft 160 is oriented at an oblique angle relative to the longitudinal axis D-D of the second bristle tuft 160. In the exemplified embodiment, the second outer distal surface 167 of the second bristle tuft 160 is parallel to the second inner distal surface 170 of the second bristle tuft 160. Thus, in the exemplified embodiment the second inner distal surface 170 of the second bristle tuft 160 and the second outer distal surface 167 of the second bristle tuft 160 are oriented at the same oblique angle relative to the longitudinal axis D-D. The exact oblique angle is not to be limiting of the present invention in all embodiments, but could be in a range of 70-89° in some embodiments, 75-89° in some embodiments, 80-89° in some embodiments, 80-85° in some embodiments, or the like. In alternative embodiments, the second inner and outer distal surfaces 167, 170 of the second bristle tuft 160 may be oriented at different oblique angles relative to the longitudinal axis D-D. In still other embodiments, at least one, or both, of the second inner and outer distal surfaces 167, 170 of the second bristle tuft 160 may be oriented perpendicular to the longitudinal axis D-D.

In the exemplified embodiment, the second outer distal surface 167 of the second bristle tuft 160 is planar, meaning that it lies in a plane. Similarly, the second inner distal surface 170 of the second bristle tuft 160 is planar, meaning that it lies in a plane. These planes are parallel in the exemplified embodiment but need not be in all embodiments as described herein above. Of course, the second outer and inner distal surfaces 167, 170 of the second bristle tuft 160 may not be planar in all embodiments, but may instead be rounded, wavy, or the like.

Figure 8:
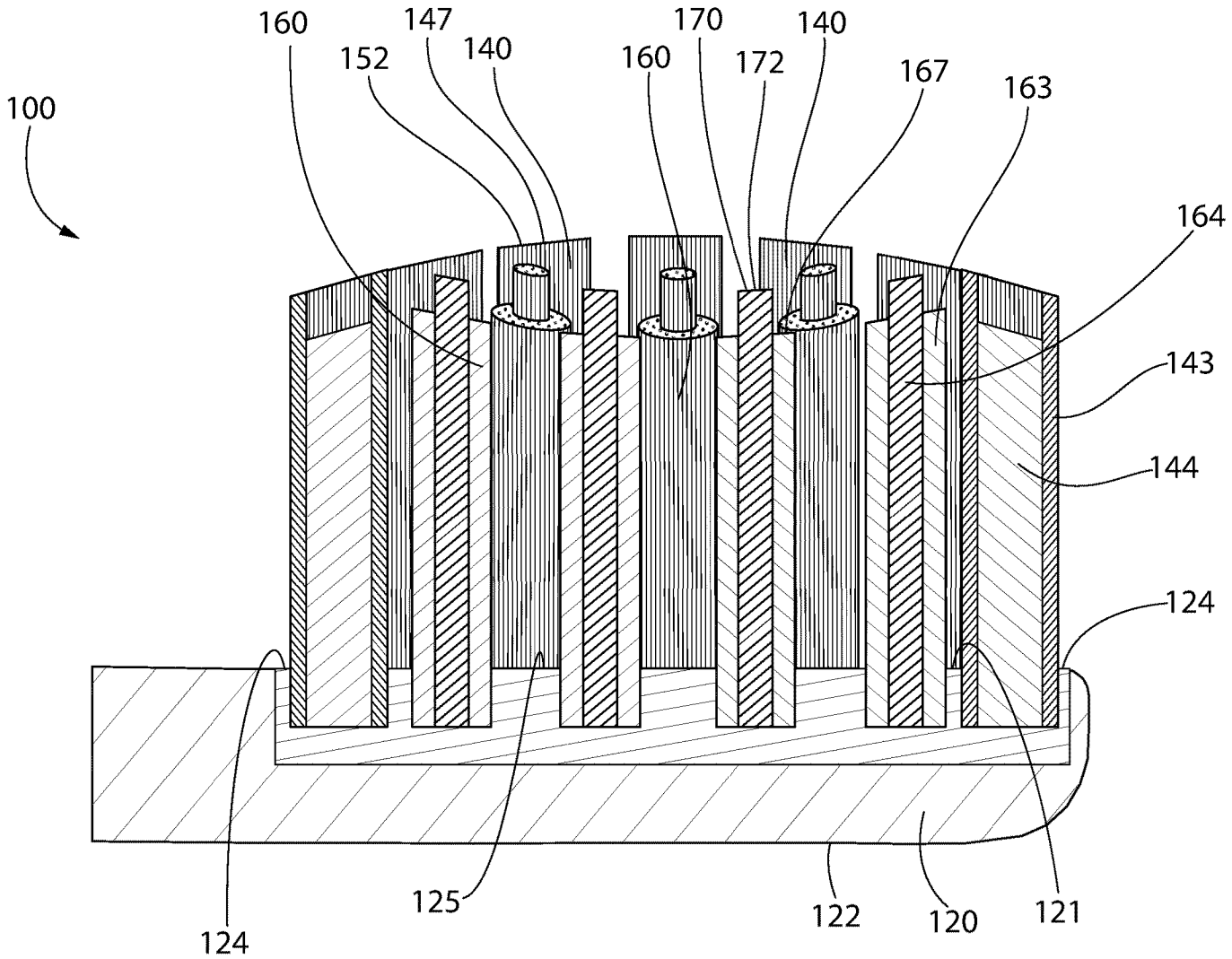
FIG. 8 is a cross-sectional view taken along line VIII-VIII of FIG. 3.
Figure 9:
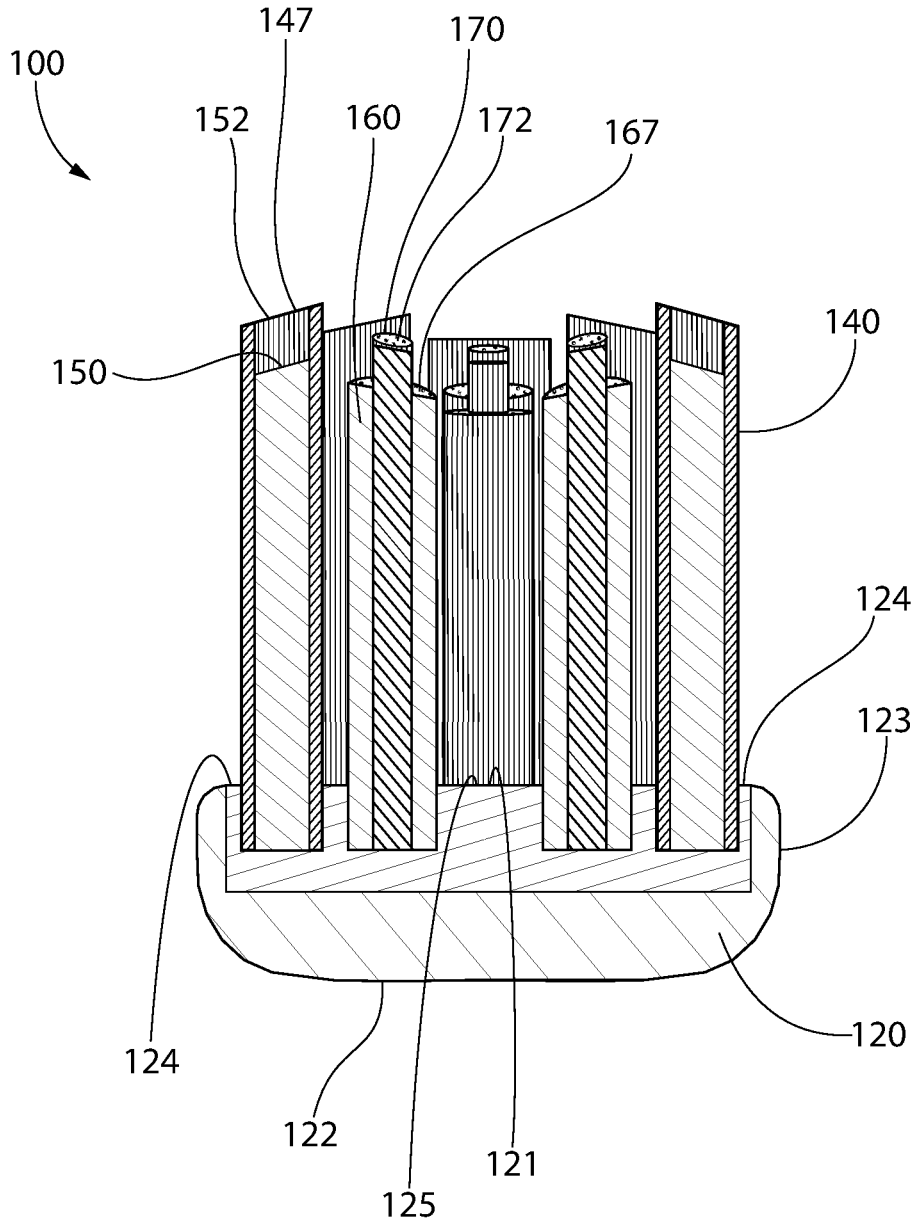
FIG. 9 is a cross-sectional view taken along line IX-IX of FIG. 3.

Referring to FIGS. 8 and 9, cross-sectional views of the head 120 of the oral care implement 100 are provided taken along the longitudinal axis A-A and the transverse axis B-B. As noted above, in this embodiment the first bristle tufts 140 are positioned along the perimeter portion 124 of the front surface 121 of the head 120 and the second bristle tufts 160 are positioned along the central portion 125 of the front surface 121 of the head 120. Furthermore, the heights of the first bristle tufts 140 are varied so that the terminal ends 152 of the first bristle tufts 140 (or, alternatively, the first outer distal surfaces 147 of the first bristle tufts 140) collectively form a convex side profile. Thus, when viewed from the side of the head 120 as depicted in FIG. 8, the terminal ends 152 of the first bristle tufts 140 collectively have a convex shape. Moreover, the heights of the second bristle tufts 150 are varied so that the terminal ends 172 of the second bristle tufts 160 (or, alternatively, the first outer distal surfaces 167 of the second bristle tufts 160, the first inner distal surfaces 170 of the second bristle tufts 160, or a combination thereof) collectively form a concave side profile. Thus, when viewed from the side of the head 120 as depicted in FIG. 8, the terminal ends 172 of the second bristle tufts 160 collectively have a concave shape. The terminal ends 172 of the second bristle tufts 160 may also form a concave shape when viewed in a transverse side profile, such as that depicted in FIG. 9.

Furthermore, the terminal ends 152 of the first bristle tufts 140 are inclined so that they slope upwardly in a direction towards the central portion 125 of the front surface 121 of the head 120. Thus, the terminal ends 152 of the first bristle tufts 140 are inclined to slope upwardly in a direction towards the second bristle tufts 160 that are located within the central portion 125 of the front surface 121 of the head 120. This means that the height of the first bristle tufts 140 increases when moving in a direction from the lateral side 123 of the head 120 towards the central portion 125 of the front surface 121 of the head 120. Because both the outer distal surfaces 147 and the inner distal surfaces 150 of the first bristle tufts 140 are angled as described above, both the outer distal surfaces 147 and the inner distal surfaces 150 are inclined and slope upwardly towards the central portion 125 and towards the second bristle tufts 160. Stated still another way, the terminal end 152 of each of the first bristle tufts 140 is inclined and slopes upwardly in a direction towards the longitudinal axis A-A of the head 120 and/or towards the transverse axis B-B of the head 120.

The terminal ends 172 of the second bristle tufts 160 are inclined so that they slope upwardly in a direction towards the perimeter portion 124 of the front surface 121 of the head 120. Thus, the terminal ends 172 of the second bristle tufts 160 are inclined to slope upwardly in a direction towards the first bristle tufts 140 that are located within the perimeter portion 124 of the front surface 121 of the head 120. This means that the height of the second bristle tufts 160 increases when moving in a direction from the central portion 125 of the front surface 121 of the head 120 towards the lateral side 123 of the head 120. Because both the outer distal surfaces 167 and the inner distal surfaces 170 of the second bristle tufts 160 are angled as described above, both the outer distal surfaces 167 and the inner distal surfaces 170 are inclined and slope upwardly towards the perimeter portion 124 (or towards the lateral side 123) and towards the first bristle tufts 140. Stated still another way, the terminal end 172 of each of the second bristle tufts 160 is inclined and slops upwardly in a direction away from the longitudinal axis A-A of the head 120 and away from the transverse axis B-B of the head 120.

Figure 10:
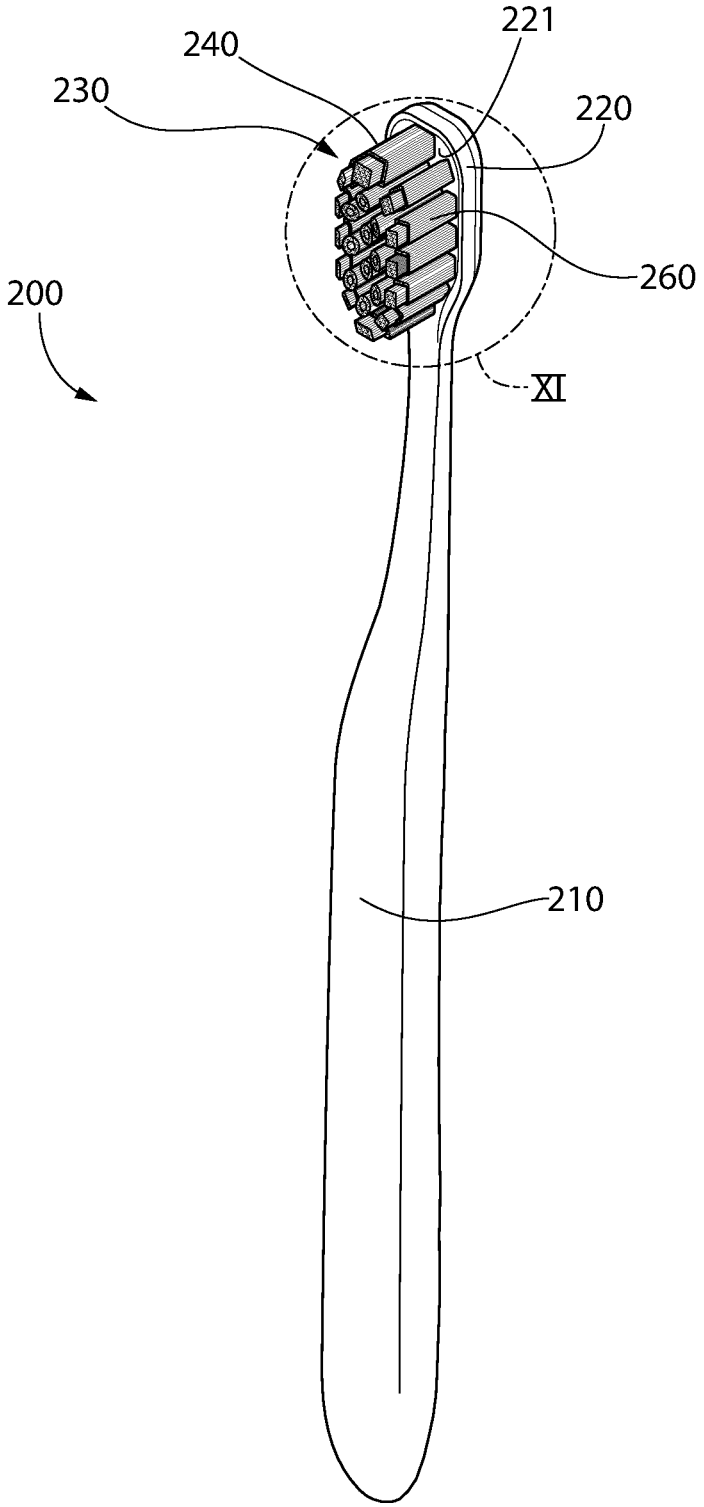
FIG. 10 is a perspective view of an oral care implement in accordance with a second embodiment of the present invention.
Figure 11:
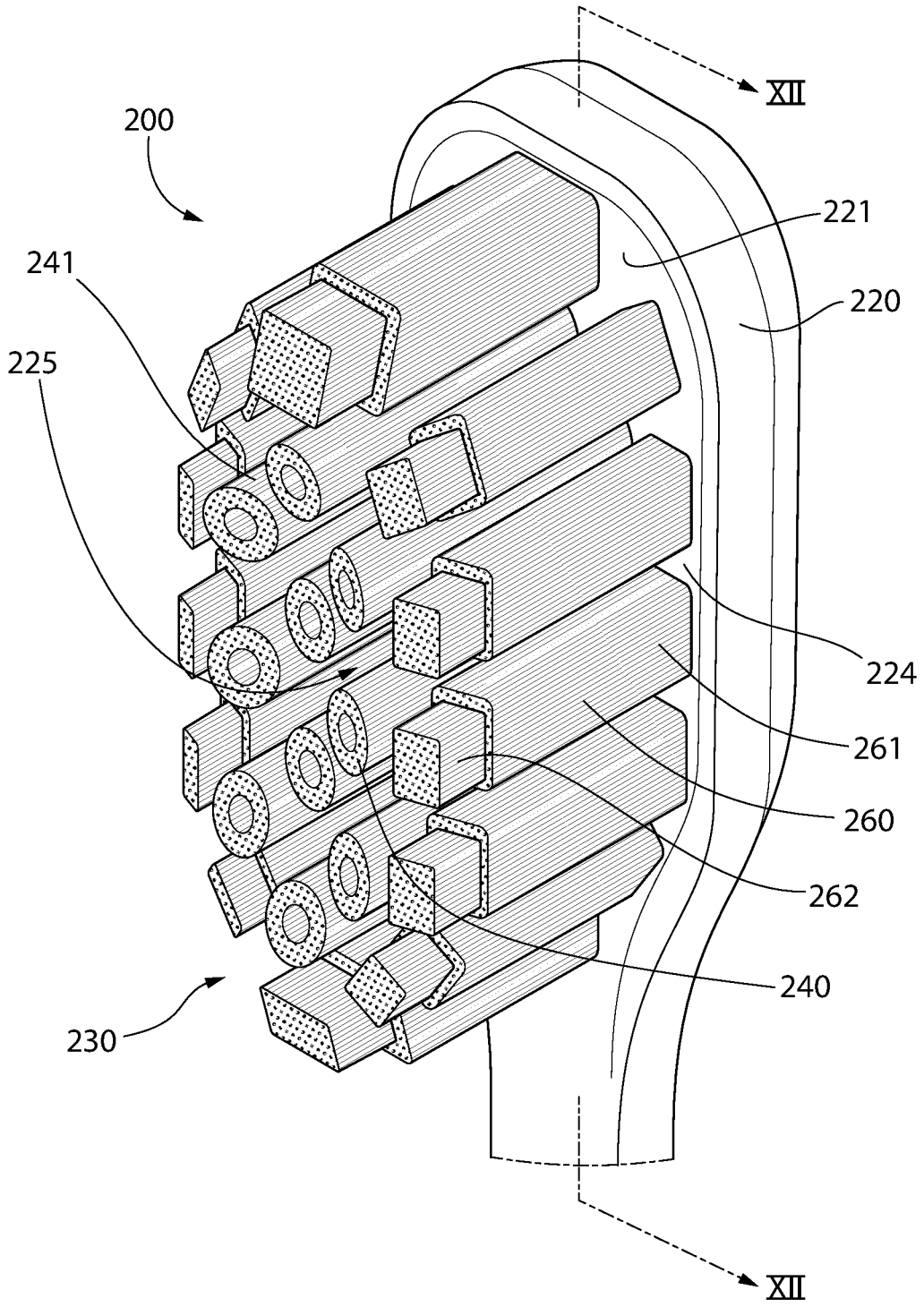
FIG. 11 is a close-up view of area XI of FIG. 10.
Figure 12:
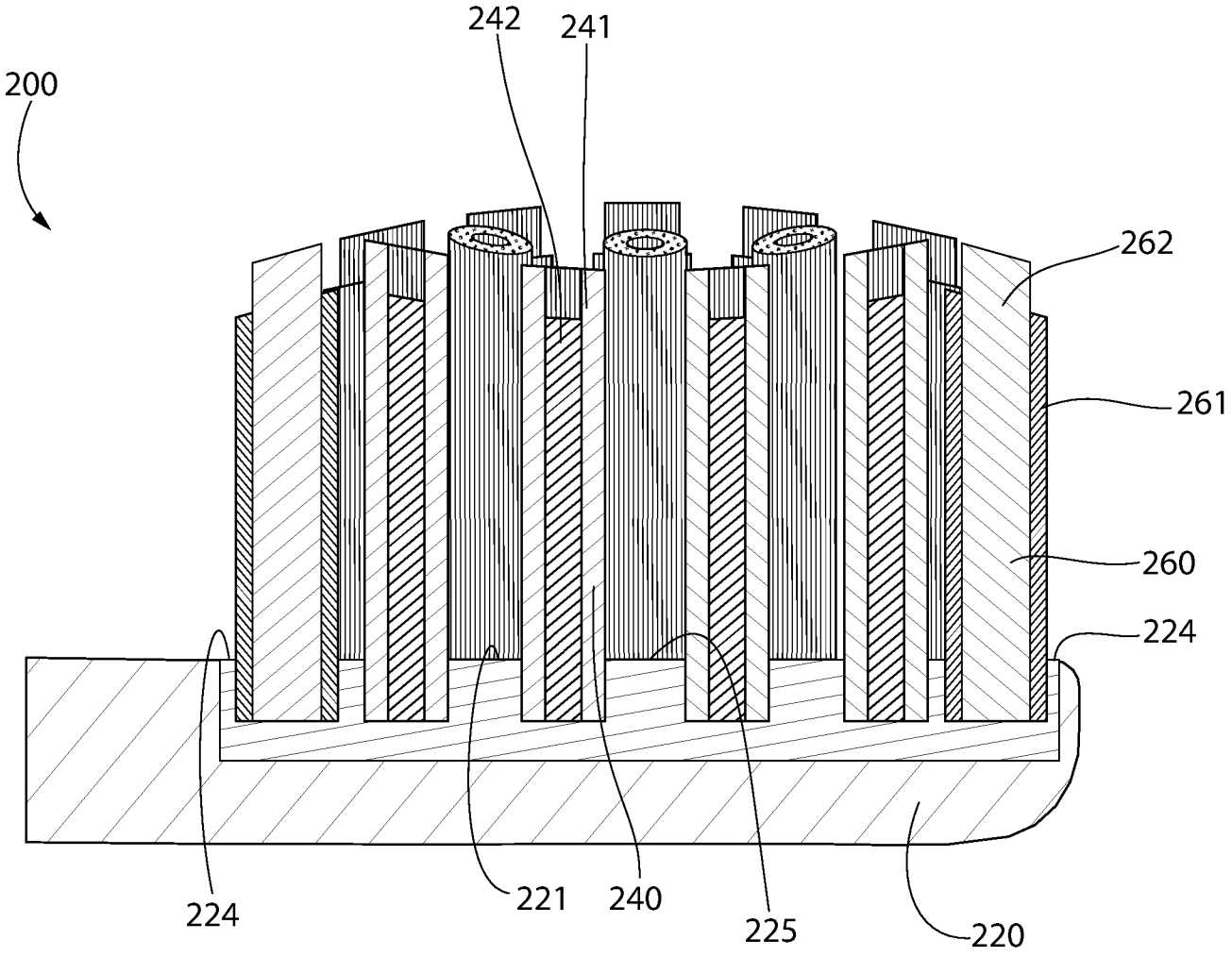
FIG. 12 is a cross-sectional view taken along line XII-XII of FIG. 11.

Referring to FIGS. 10-12, an alternative embodiment of an oral care implement 200 will be briefly described. The oral care implement 200 is very similar to the oral care implement 100 described above, and thus features that are the same will not be described herein in detail in the interest of brevity. Features of the oral care implement 200 that are similar to the oral care implement 100 will be described using the same reference numerals except in the 200-series of numbers rather than the 100-series of numbers. Thus, the description above can be referenced for certain details of the features of the oral care implement 200 that are not provided below.

The oral care implement 200 comprises a handle 210 and a head 220. The head 220 comprises a front surface 221 having a perimeter portion 224 and a central portion 225, the perimeter portion 224 surrounding the central portion 225. The oral care implement 200 comprises a plurality of cleaning elements 230 coupled to the head 220 and extending from the front surface 221 of the head 220. The cleaning elements 230 comprises a plurality of first bristle tufts 240 and a plurality of second bristle tufts 260.

The first bristle tufts 240 are identical to the first bristle tufts 140 of the oral care implement 100 described above the second bristle tufts 260 are identical to the second bristle tufts 160 of the oral care implement 100 described above. Thus, the first bristle tufts 240 comprise a plurality of first outer filaments 241 that surround a plurality of first inner filaments 242 whereby the first outer filaments 241 are taller than the plurality of first inner filaments 241. The second bristle tufts 260 comprise a plurality of second outer filaments 261 that surround a plurality of second inner filaments 262 whereby the second outer filaments 261 are shorter than the plurality of second inner filaments 262. The difference is that in this embodiment the plurality of first bristle tufts 240 are positioned along the central portion 225 of the front surface 221 of the head 220 and the plurality of second bristle tufts 260 are positioned along the perimeter portion 224 of the front surface 221 of the head 220.

Another difference is that in this embodiment the first bristle tufts 240 have a circular transverse cross-sectional shape and the second bristle tufts 260 have a rectangular transverse cross-sectional shape, whereas in the previous embodiment the first bristle tufts 140 have a rectangular transverse cross-sectional shape and the second bristle tufts 160 have a circular transverse cross-sectional shape. These shapes are merely exemplary and are not intended to be limiting of the invention. In some embodiments all of the bristle tufts may have a circular transverse cross-sectional shape, a square or rectangular transverse cross-sectional shape, a triangular transverse cross-sectional shape, or the like.

Figure 13:
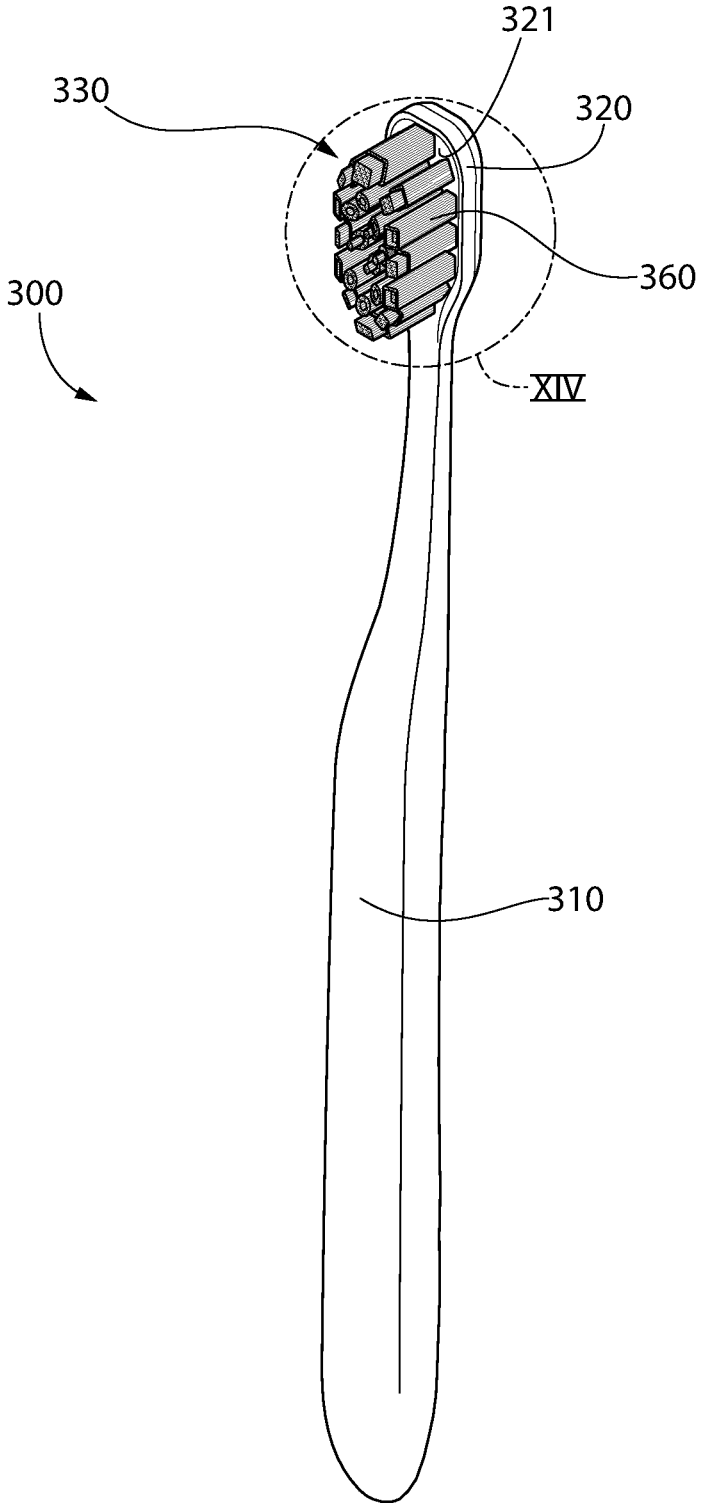
FIG. 13 is a perspective view of an oral care implement in accordance with a third embodiment of the present invention.
Figure 14:
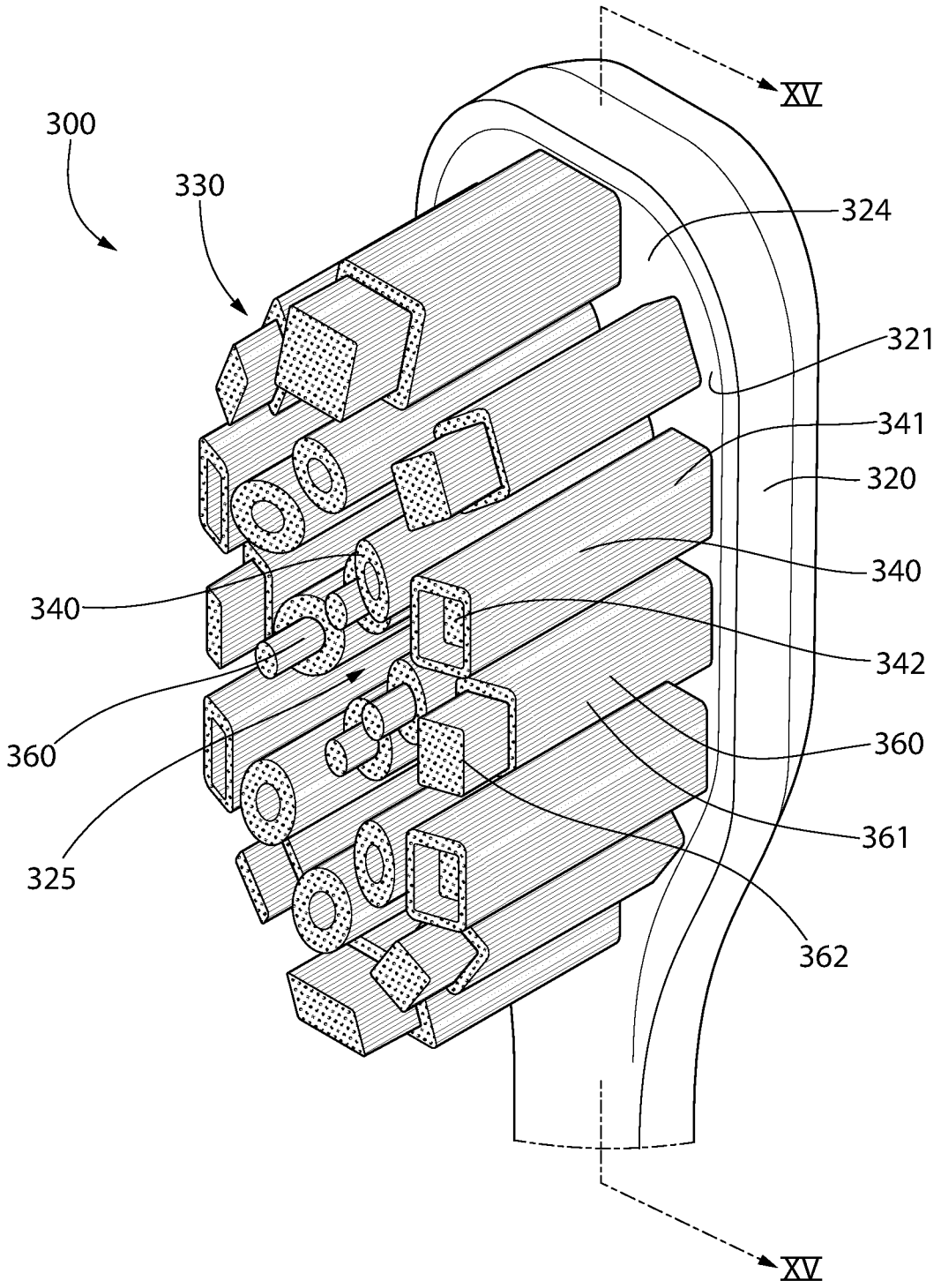
FIG. 14 is a close-up view of area XIV of FIG. 13.
Figure 15:
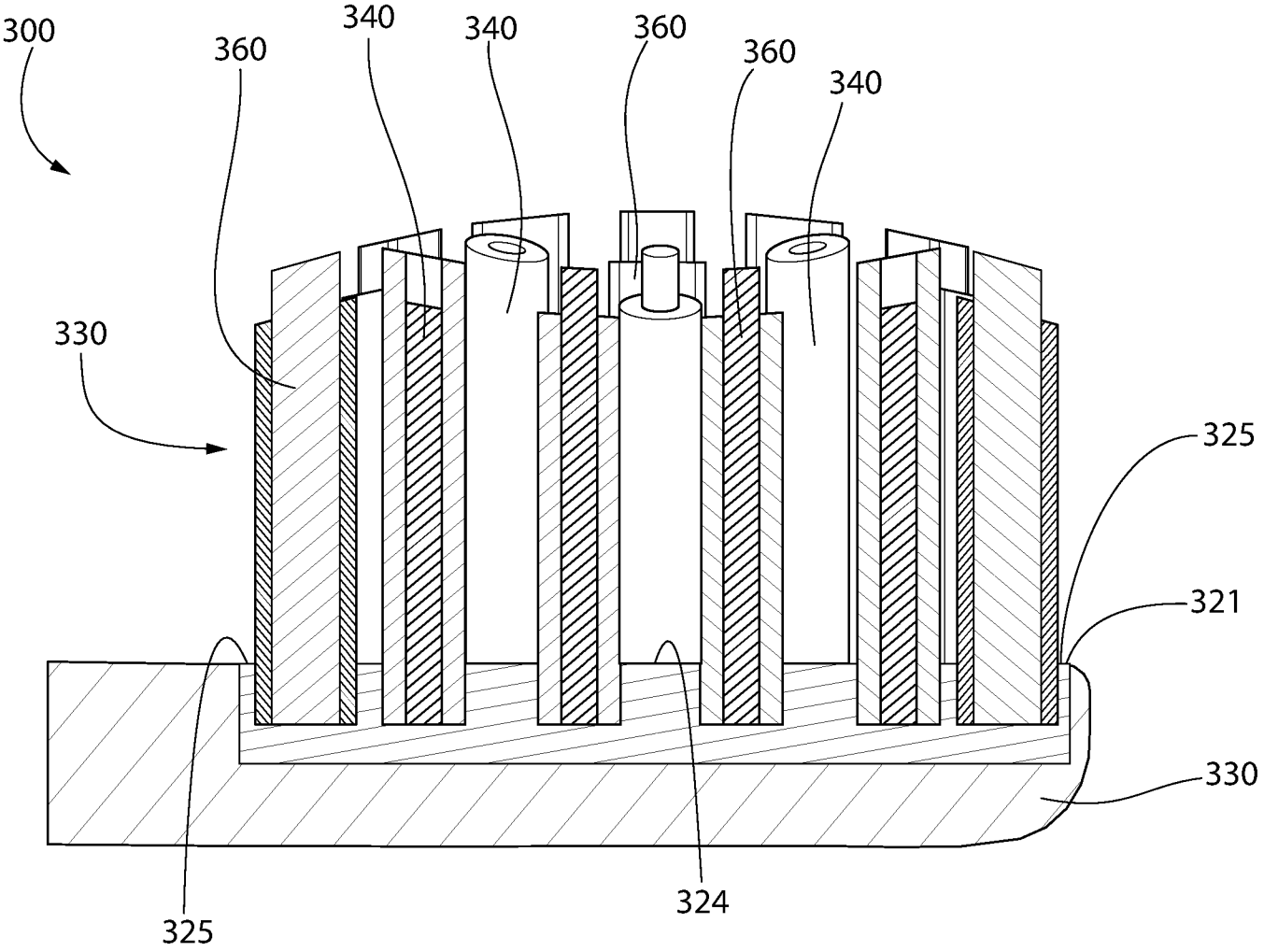
FIG. 15 is a cross-sectional view taken along line XV-XV of FIG. 14.

Referring to FIGS. 13-15, another alternative embodiment of an oral care implement 300 will be briefly described. The oral care implement 300 is very similar to the oral care implement 100 described above, and thus features that are the same will not be described herein in detail in the interest of brevity. Features of the oral care implement 300 that are similar to the oral care implement 100 will be described using the same reference numerals except in the 300-series of numbers rather than the 100-series of numbers. Thus, the description above can be referenced for certain details of the features of the oral care implement 300 that are not provided below.

The oral care implement 300 comprises a handle 310 and a head 320. The head 320 comprises a front surface 321 having a perimeter portion 324 and a central portion 325, the perimeter portion 324 surrounding the central portion 325.

The oral care implement 300 comprises a plurality of cleaning elements 330 coupled to the head 320 and extending from the front surface 321 of the head 320. The cleaning elements 330 comprises a plurality of first bristle tufts 340 and a plurality of second bristle tufts 360.

The first bristle tufts 340 are identical to the first bristle tufts 140 of the oral care implement 100 described above the second bristle tufts 360 are identical to the second bristle tufts 160 of the oral care implement 100 described above. Thus, the first bristle tufts 340 comprise a plurality of first outer filaments 341 that surround a plurality of first inner filaments 342 whereby the first outer filaments 341 are taller than the plurality of first inner filaments 342. The second bristle tufts 360 comprise a plurality of second outer filaments 361 that surround a plurality of second inner filaments 362 whereby the second outer filaments 361 are shorter than the plurality of second inner filaments 362.

The difference is that in this embodiment the some of the first bristle tufts 340 are located along the perimeter portion 324 of the front surface 321 of the head 320 and some of the first bristle tufts 340 are located along the central portion 325 of the front surface 321 of the head 320. Moreover, in this embodiment some of the second bristle tufts 360 are located along the perimeter portion 324 of the front surface 321 of the head 320 and some of the second bristle tufts 360 are located along the central portion 325 of the front surface 321 of the head 320. In this embodiment, the bristle tufts having the shorter core portion (i.e., the first bristle tufts 340 and the bristle tufts having the taller core portion (i.e., the second bristle tufts 360) may be arranged or positioned in a random way along the front surface 321 of the head 320.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head comprising a front surface having a perimeter portion and a central portion, wherein the perimeter portion surrounds the central portion;

a plurality of first bristle tufts extending from the perimeter portion of the front surface of the head, each of the first bristle tufts comprising a plurality of first outer filaments and a plurality of first inner filaments, the first outer filaments surrounding the first inner filaments, and wherein each of the first outer filaments is taller than each of the first inner filaments;

a plurality of second bristle tufts extending from the central portion of the front surface of the head, each of the second bristle tufts comprising a plurality of second outer filaments and a plurality of second inner filaments, the second outer filaments surrounding the second inner filaments, and wherein each of the second outer filaments is shorter than each of the second inner filaments; and wherein the plurality of first bristle tufts surround the plurality of second bristle tufts, and each of the plurality of first bristle tufts is taller than each of the plurality of second bristle tufts.

2. The oral care implement according to claim 1 wherein the head comprises a rear surface opposite the front surface and a lateral surface extending between the front and rear surfaces, and wherein the perimeter portion of the front surface of the head is an annular portion of the front surface of the head that extends from the lateral surface to the central portion of the front surface of the head.

3. The oral care implement according to claim 1 wherein the plurality of first bristles tufts are arranged in a spaced apart manner along the perimeter portion of the front surface of the head, and wherein the plurality of first bristle tufts form a loop that surrounds the central portion of the front surface of the head.

4. The oral care implement according to claim 1 wherein only the plurality of first bristle tufts are located along the perimeter portion of the front surface of the head and wherein only the plurality of second bristles tufts are located along the central portion of the front surface of the head.

5. The oral care implement according to claim 1 wherein the plurality of first and second bristle tufts are the only cleaning elements extending from the front surface of the head.

6. The oral care implement according to claim 1 wherein each of the first bristle tufts comprises a longitudinal axis, wherein the plurality of first outer filaments of the first bristle tufts terminate in a first outer distal surface, and wherein for each of the first bristle tufts, the first outer distal surface is oriented oblique to the longitudinal axis.

7. The oral care implement according to claim 6 wherein the plurality of first inner filaments of the first bristle tufts terminate in a first inner distal surface and wherein for each of the first bristle tufts, the first inner distal surface is oriented oblique to the longitudinal axis.

8. The oral care implement according to claim 7 wherein the first outer distal surface lies in a first plane and wherein the first inner distal surface lies in a second plane, the first and second planes being parallel.

9. The oral care implement according to claim 6 wherein the first outer distal surfaces of the first bristle tufts collectively form a convex side profile.

10. The oral care implement according to claim 9 wherein for each of the plurality of second bristle tufts, the plurality of outer filaments terminate in a second outer distal surface, and wherein the second outer distal surfaces of the second bristle tufts collectively form a concave side profile.

11. The oral care implement according to claim 1 wherein the head comprises a rear surface opposite the front surface and a lateral surface extending between the front and rear surfaces, wherein the plurality of first outer filaments of the first bristle tufts terminate in a first outer distal surface, and wherein for each of the first bristle tufts, the first outer distal surface is angled downwardly moving in a direction away from the central portion of the front surface of the head and towards the lateral surface of the head.

12. An oral care implement comprising:

a head comprising a front surface having a perimeter portion and a central portion, wherein the perimeter portion surrounds the central portion;

a plurality of first bristle tufts extending from the central portion of the front surface of the head, each of the first bristle tufts comprising a plurality of first outer filaments and a plurality of first inner filaments, the first outer filaments surrounding the first inner filaments, and wherein each of the first outer filaments is taller than each of the first inner filaments;

a plurality of second bristle tufts extending from the perimeter portion of the front surface of the head, each of the second bristle tufts comprising a plurality of second outer filaments and a plurality of second inner filaments, the second outer filaments surrounding the second inner filaments, and wherein each of the second outer filaments is shorter than each of the second inner filaments; and wherein the plurality of second bristle tufts surround the plurality of first bristle tufts, and wherein at least one of the pluralities of first bristle tufts is as tall as at least one of the pluralities of second bristle tufts.

13. The oral care implement according to claim 12 wherein for each of the plurality of second bristle tufts, the second outer filaments terminate in a second outer distal surface, and wherein the second outer distal surfaces collectively form a convex side profile.

14. The oral care implement according to claim 13 wherein for each of the plurality of first bristle tufts, the first outer filaments terminate in a first outer distal surface, and wherein the first outer distal surfaces collectively form a concave side profile.

15. The oral care implement according to claim 12 wherein the plurality of second bristles tufts are arranged in a spaced apart manner along the perimeter portion of the front surface of the head, and wherein the plurality of second bristle tufts form a loop that surrounds the central portion of the front surface of the head.

16. The oral care implement according to claim 12 wherein only the plurality of second bristle tufts are located along the perimeter portion of the front surface of the head and wherein only the plurality of first bristles tufts are located along the central portion of the front surface of the head.

17. The oral care implement according to claim 12 wherein the plurality of first and second bristle tufts are the only cleaning elements extending from the front surface of the head.

18. An oral care implement comprising:

a head comprising a front surface having a perimeter portion and a central portion, wherein the perimeter portion surrounds the central portion;

a plurality of first bristle tufts extending from the perimeter portion of the front surface of the head, each of the first bristle tufts comprising a plurality of first outer filaments and a plurality of first inner filaments, the first outer filaments surrounding the first inner filaments, wherein each of the first outer filaments is taller than each of the first inner filaments;

a plurality of second bristle tufts extending from the central portion of the front surface of the head, each of the second bristle tufts comprising a plurality of second outer filaments and a plurality of second inner filaments, the second outer filaments surrounding the second inner filaments, and wherein each of the second outer filaments is shorter than each of the second inner filaments; and wherein the plurality of first bristle tufts surround the plurality of second bristle tufts, and wherein only the plurality of first bristle tufts are located along the perimeter portion of the front surface of the head and wherein only the plurality of second bristles tufts are located along the central portion of the front surface of the head.

19. The oral care implement according to claim 18 wherein each of the plurality of first bristle tufts is taller than each of the plurality of second bristle tufts.

20. The oral care implement according to claim 18 wherein the head comprises a rear surface opposite the front surface and a lateral surface extending between the front and rear surfaces, wherein the plurality of first outer filaments of the first bristle tufts terminate in a first outer distal surface, and wherein for each of the first bristle tufts, the first outer distal surface is angled downwardly moving in a direction away from the central portion of the front surface of the head and towards the lateral surface of the head.

* * * * *